US006280219B1

(12) United States Patent
Sano et al.

(10) Patent No.: US 6,280,219 B1
(45) Date of Patent: Aug. 28, 2001

(54) SOCKET APPARATUS FOR IC PACKAGES

(75) Inventors: Hideki Sano, Gotenba; Kiyokazu Ikeya, Shizuoka, both of (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/753,479

(22) Filed: Jan. 3, 2001

(30) Foreign Application Priority Data

Jan. 28, 2000 (JP) ..... 2000-020253

(51) Int. Cl.[7] ..... H01R 11/22
(52) U.S. Cl. ..... 439/268; 439/330
(58) Field of Search ..... 439/259, 261–266, 439/268–270, 330

(56) References Cited

U.S. PATENT DOCUMENTS 4,343,524 * 8/1982 Bright et al. ..... 439/268
4,889,499 * 12/1989 Sochor ..... 439/268
5,342,213 * 8/1994 Kobayashi ..... 439/268
5,498,970 * 3/1996 Petersen ..... 324/755
5,690,281 11/1997 Ikeya et al. .
6,050,836 4/2000 Tohyama .

* cited by examiner

*Primary Examiner*—Khiem Nguyen
(74) *Attorney, Agent, or Firm*—Russell E. Baumann; Frederick J. Telecky, Jr.

(57) ABSTRACT

A socket (10) having a base (12), an adapter (24) which has a mounting seat for a semiconductor device (100) and which is installed on the base, and a plurality of contact members (14) which are caused to engage respective terminals of the semiconductor device that has been placed on the mounting seat of the adapter. Each contact member (14) has a pair of arms (90, 130, 144) provided by the bifurcation of one end, with the other end being fixed to the base. Each contact member is caused to nip a respective terminal (102) of the semiconductor device arranged on the mounting seat at the tip portion of the pair of arms and has butting surfaces (92, 131, 148) that determine the minimum spacing distance of the tip portions of the arms on the opposing sides of each pair of arms. Contact members (14) are connected to socket terminals (21) via a connector including an expansion board (20), conductive wires (150, 160), flexible printed substrate (170), sockets (190, 200, 214) and lead guides (222, 224) in several embodiments.

19 Claims, 21 Drawing Sheets

SOCKET APPARATUS FOR IC PACKAGES

FIELD OF THE INVENTION

This inventions relates generally to sockets for mounting semiconductor devices such as integrated circuits (ICs) having a plurality of terminals, such as BGA (Ball Grid Array), FBGA (Fine Pitch BGA) and CSP (Chip Scale Package, and more particularly to sockets to be used in a burn-in test of the ICs.

BACKGROUND OF THE INVENTION

Various tests are conducted for the purpose of eliminating newly manufactured ICs that do not meet a required specification. In a burn-in test, the products have their heat-resistant characteristics tested by operating them at certain high temperatures for a prescribed period of time so as to identify and eliminate those which do not have the required properties. In a burn-in test, the IC is mounted on a socket which has been prepared specifically for it, with the socket being mounted on a printed circuit substrate, and placed in a heating furnace.

Various kinds of sockets have been proposed for burn-in tests for IC packages of the BGA, FBGA and CSP types which have become popular in recent years. These sockets are provided with a base member of an electrical insulating material mounting a plurality of contact members that correspond to the terminals of the IC. The contact members are arranged in conformity with the terminals on the mounting surface of the IC so that, when the IC has been placed on the base member, the contact members establish electrical contact with corresponding terminals. In the case of a typical socket of this kind, a cover member, movable between open and closed positions, is provided for attaching the IC on a mounting seat with the IC being attached to or released from the mounting seat as the cover is moved to one position or the other.

With reference to FIGS. 23 and 24, a known socket has a cover 232 rotatably supported relative to a base 231. When cover 232 is opened as shown in FIG. 23, IC 100 can be placed onto a mounting seat 231*a* and cover 232 is then closed by an automatic mechanism, not shown in the drawing. A hook 233 engages with a catch on base 231, thereby maintaining cover 232 closed. IC 100 is held on mounting seat 231 a from above by an engagement surface 232*a* inside cover 232, with the IC terminals being held in contact with tips of contact members 234 that corresponds thereto.

Other types of sockets are provided with a mechanism for vertically moving the cover member relative to the base member and a latch that can be opened or closed in linkage with the movement of the cover. Generally speaking, the latch opens when the cover member is lowered, thereby making it possible for an IC to be placed on the mounting seat of the base with the latch closing and holding the IC on the mounting seat from above when the cover is raised. In any type of the sockets described above, the electrical connections of the socket to the terminals of the IC are effected by pressing of the lower part of the terminals of the IC to the tips of the contact members. If there are variations in the installed height of the terminals of the IC, however, the force of the contact members against the terminals will vary, thereby adversely affecting the reliability of the connection between some terminals and contact members. Additionally, there are some cases where the lower surfaces of the terminals of the IC are subjected to damage occasioned by pressing of the contact members against the terminals. Any damage to the lower surface of the terminals could cause soldering failure when, upon successful testing, the IC is mounted to a printed substrate.

SUMMARY OF THE INVENTION

Accordingly, it is an object of the present invention to provide a socket having contact members which will more reliably engage the terminals of the IC so as to establish contact therewith. Another object of the invention is the provision of a socket having contact members which minimize possible damage to the terminal region of the IC held by the contact members. Still another object of the invention is the provision of a socket having contact members which adapt to the positions of the various terminals even where there are variations or dislocations in the arrangement of the terminals of the IC as compared with the arrangement of the contact members.

This invention relates to a socket for use with an IC having a plurality of terminals on at least one surface thereof. A socket made according to the invention includes a base on which is mounted an adapter that has a mounting region or seat for a semiconductor device, and a plurality of contact members mounted on the base for establishing electrical contact with respective terminals of an IC placed on the mounting seat. Each contact member is bifurcated to form a pair of arms at one end with the other end being fixed to the base. The free end tip portions of the pair of arms of each contact nip a respective terminal of on IC that has been placed in the mounting seat. The contact members also have butting surfaces on facing sides of the arms which determine the minimum spacing distance between the tip portions of the arms of each pair. Moreover, a socket made according to the invention has contact member opening and closing members that open and close the pair of arms of the contact members and an opening and closing mechanism therefor. Each contact member opening and closing member is supported to move between the pair of arms of respective contact members and has a first position where the tip portions of the arms are opened and a second position where engagement between the butting surfaces of the arms is permitted. The contact member opening and closing members are moved by the opening and closing mechanism between the first and second positions. In a preferred embodiment of the invention, the contact member opening and closing members are moved upwardly and downwardly between each pair of arms of the contact members by the opening and closing mechanism. In this case, the contact member opening and closing members can be constructed so that they engage the butting surfaces of the arms at the first position, thereby causing their tip portions to be opened. According to a feature of a preferred embodiment of the invention, the contact member opening and closing members have a prescribed clearance with the arms at the second position. The clearance makes it possible for the tips of the contact members to follow a terminal even where there may be a dislocation in the position of a terminal of the IC relative to the contact member. Preferably, arms of the contact members are constructed so that the butting surfaces of the arms of each pair can engage each other. According to another feature of the invention, the pairs of arms of the contact members are provided with contact surfaces that engage the IC base side of generally spherical terminals rather than the maximum diameter part of the terminals. A socket made according to the invention further includes through holes which form guide surfaces that guide the bifurcated arms of the contact members. The socket is provided with a slider which includes the opening and closing members formed in the through holes with the slider moved by the opening and closing mechanism. According to a feature of the invention, support portions of the slider protrude above the mounting seat of the adapter, thereby making it possible for the IC to be mounted thereon when the contact member opening and closing members are at the first position and, at the same time, recede from the mounting seat so that each terminal of the IC comes between the arms of a respective contact member when the contact member opening and closing members move to the second position. A socket made in accordance with the invention is further provided with a latch that has an open position so that an IC can be arranged on the mounting seat of the adapter and a closed position so that the IC that has been placed on the mounting seat can be clamped from above, with the opening and closing mechanism desirably being caused to move the latch to its open position when the contact member open and closing members are moved to the first position and to move the latch to the closed position when the contact member opening and closing members are moved to the second position. In addition, the opening and closing mechanism includes a cover arranged on the base and supported to move between a first position which is proximate to the base and a second position which is removed from the base, with the latch and the contact member opening and closing members being caused to operate as the cover is moved by an external means between the first and second positions. According to a feature of the invention, the opening and closing mechanism includes an operating lever which is rotatably supported on the base and which is rotated by movement of the cover and which moves the slider by its rotation.

The invention can further advantageously provide for a plurality of socket terminals that are arranged in conformity with the spacing of conductive portions on a printed substrate for the mounting of the socket and a connector means for the electrical connection of each of the contact members having a different spacing with each of the socket terminals.

BRIEF DESCRIPTION OF THE DRAWINGS

Other objects, advantages and details of the novel and improved socket of this invention appears in the following detailed description of preferred embodiments of the invention, the detailed description referring to the drawings in which:

FIG. 1A is a top plan view, FIG. 1B is a side elevational view and FIG. 1C is a front elevational view;

FIG. 8A is a top plan view, FIG. 8B is an enlarged portion of FIG. 8A, FIG. 8C is a side elevational view, partly in cross section and FIG. 1D is a cross sectional view taken on line 8D—8D of FIG. 8A;

DETAILED DESCRIPTION OF PREFERRED EMBODIMENTS

Figure 1A:
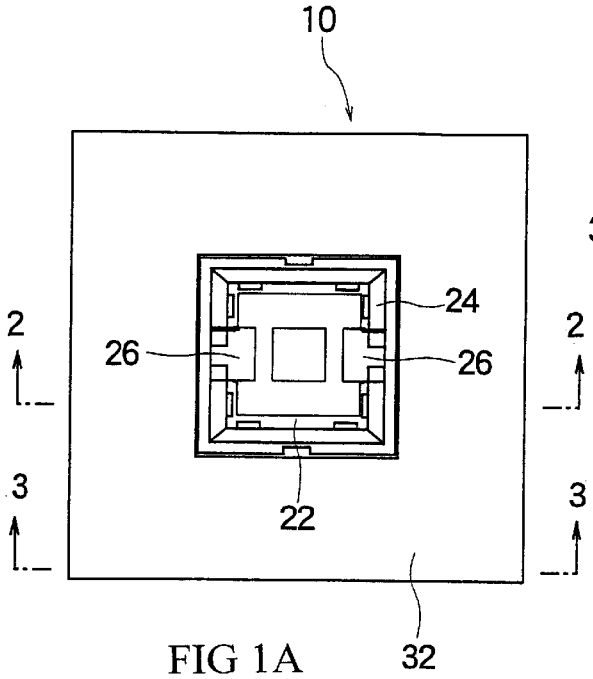
FIGS. 1A–1C show the external appearance of a socket made according to the invention.
Figure 1B:
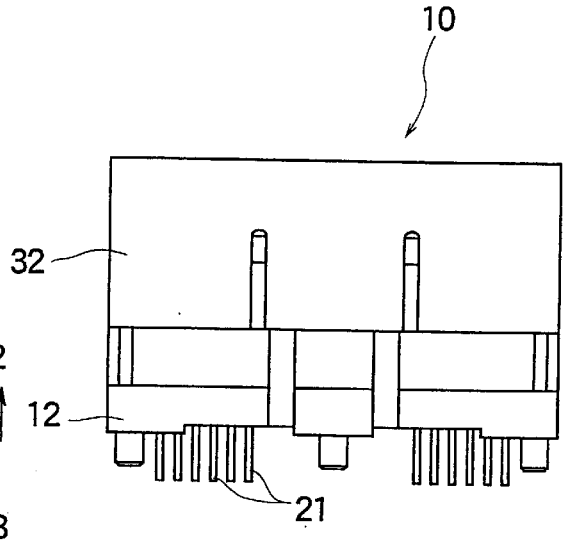
Figure 1C:
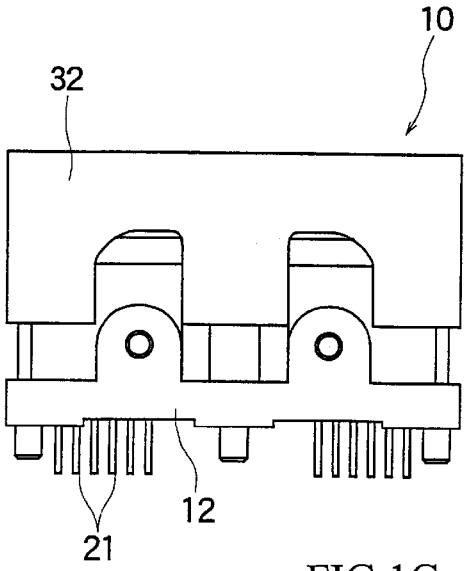

A first preferred embodiment of the invention will be described below by referring particularly to FIGS. 1A–1C and 2–5. The embodiment to be explained relates particularly to a socket which is suitable for use in a burn-in test of an IC having generally spherical solder bump terminals of a narrow pitch arrangement (with the pitch being less than 0.65 mm).

Socket 10 includes a base 12 having a selected configuration, such as a square shape, formed of electrically insulating material such as plastic, to cite an example. Contact members 14, the same in number as the terminals of solder balls 102 of an IC 100 which is the subject of the test employing this socket, are inserted from below through holes 12*a* formed in base 12 (refer to FIG. 7 for the arrangement of through holes 12*a*). Subsequent to the insertion of contact members 14 into through holes 12*a*, a stop member 16, made of material, preferably the same material as that of base 12, is provided in a recess 12*b* of the base below through holes 12*a*. The lower part of each contact member 14 is compressively inserted, i.e., forced into a through hole 16*a* of stop member 16, thereby making it possible for the top portion to be held in a free state. An electrically insulating guide member 18 is fixed to the lower surface of stop member 16, thereby securing alignment of contact members 14. As will be explained in detail below, the top end portion of each contact member 14 is bifurcated and its tip portions are caused to a contact solder ball 102 of IC 100 by spring force in such a way as to nip the solder ball from opposite sides.

An expansion board 20 is installed on the lower side of base 12 which enables the mounting of socket 10 on a printed substrate. The expansion board 20 constitutes a means whereby the contact members 14 that have been arranged at narrow a pitch in conformity with the solder balls 102 of IC 100 are connected to conductive surfaces on the printed substrate spaced further apart than the contact makers and where socket 10 is to be mounted. For the above purpose, terminals 21 are arranged on expansion board 20 to correspond to the conductive surfaces on the printed substrate. The lower end of contact members 14 that extend through stop member 16 are inserted into the expansion board 20 to be soldered. The soldered connection of contact members 14 and respective terminals 21 are electrically connected by means of a wiring pattern on expansion board 20. Other structures for connecting contact members 14 arranged in a narrow pitch with the conductive pads on the printed substrate for the same purpose will be described below by referring to FIGS. 15–22.

Figure 2:
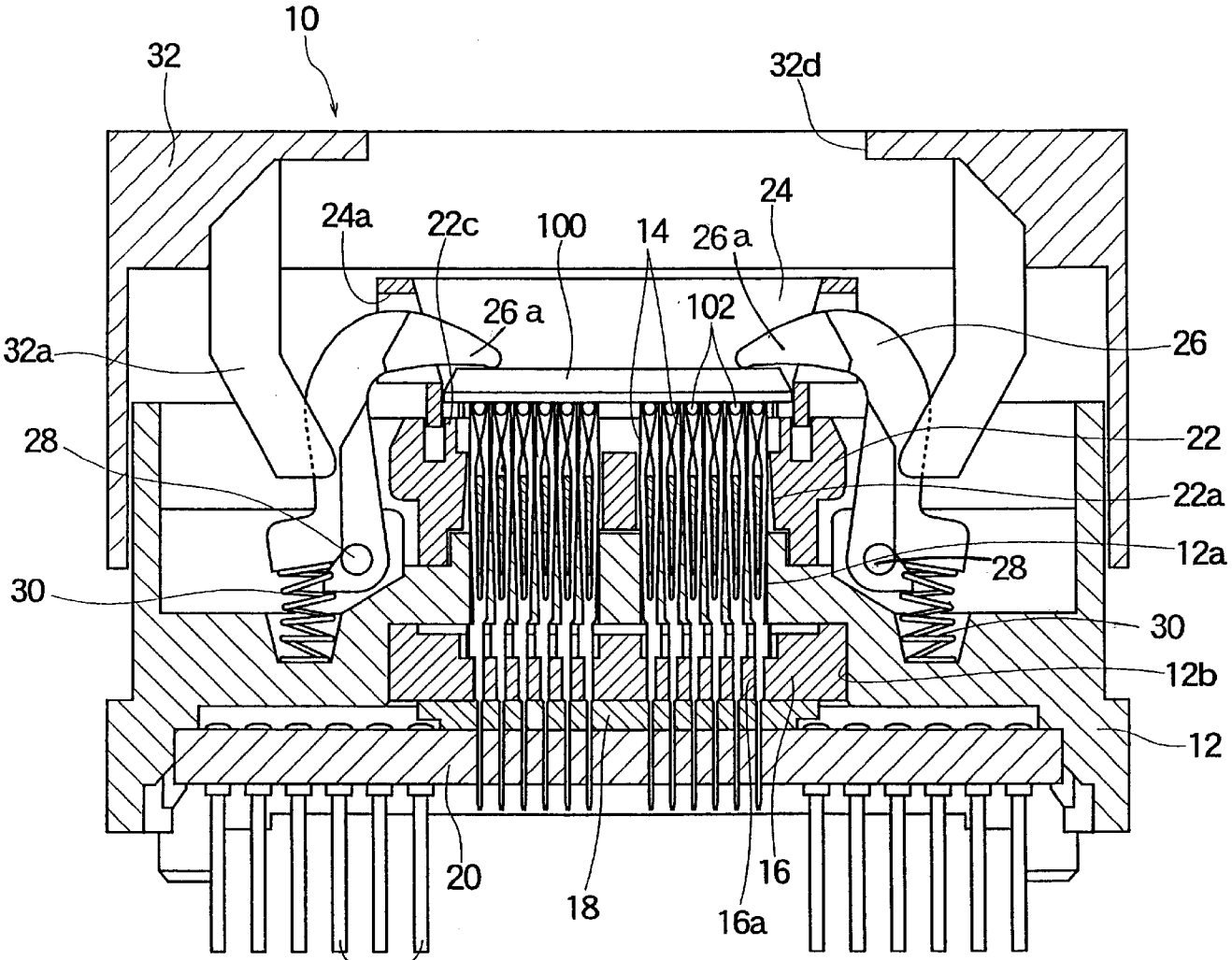
FIG. 2 is a cross sectional view taken on line 2—2 of FIG. 1A shown with an IC clamped in the socket.
Figure 4:
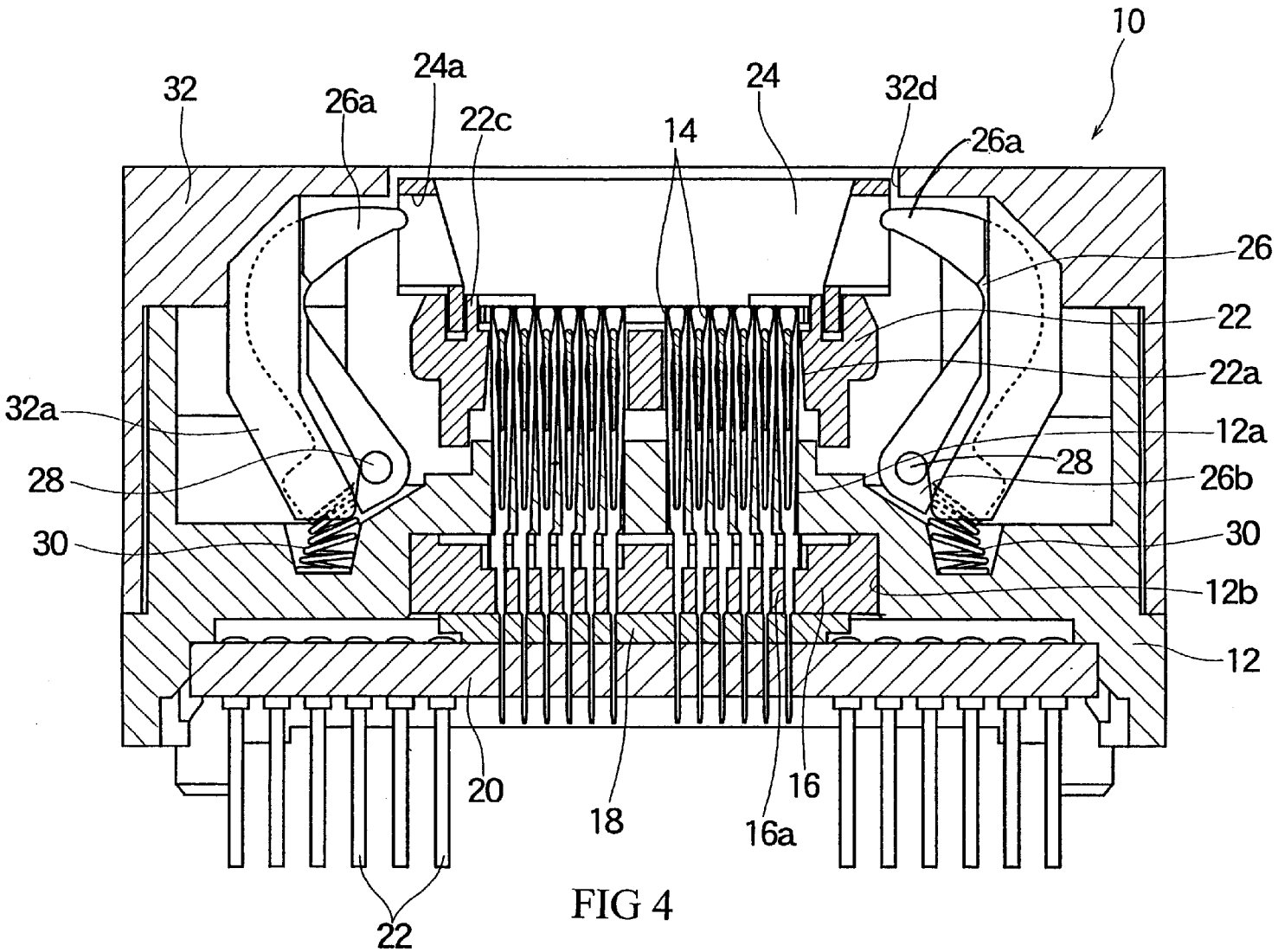
FIG. 4 is a cross sectional view taken on line 2—2 of FIG. 1A shown in the state where the IC has been released and removed.

A slider 22 and an adapter 24 are provided around contact members 14 and project above base 12 and are formed of an electrically insulating material such as the plastic used for base 12. Slider 22 is supported to move vertically toward and away from base 12 and contact members 14 within a regulated range as shown in FIGS. 2 and 4. Slider 22 is provided with a plurality of slots 22*a* through which the central portion of members 14 extend. The upper bifurcated portions of the contact members 14 are guided in such a manner as to be opened or closed inside slots 22*a*. As is clearly shown in FIGS. 8A–8D, where the parts of the slider are shown, slider cores 22*b* are formed at a prescribed distance from each other in each slot 22*a*. Each contact member 14 is provided in such a way that the bifurcated arms of the upper portion may receive a respective slider core 22*b*. therebetween. The tip portions of each contact member 14 are opened or closed by the vertical movement of the slider core 22*b* which accompanies the vertical movement of slider 22. Details of the operation of the contact members 14 by slider 22 will be explained infra.

Figure 8A:
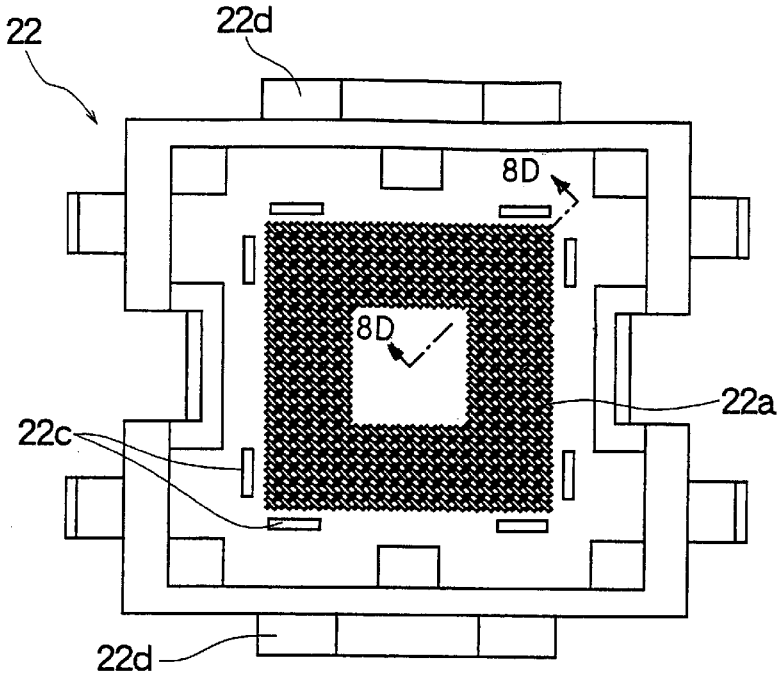
FIGS. 8A–8D show the external appearance of the slider.
Figure 8B:
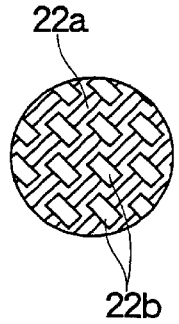
Figure 8C:
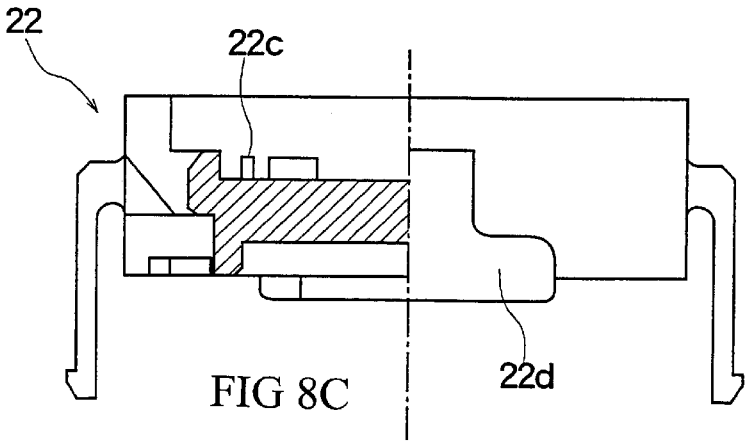
Figure 8D:
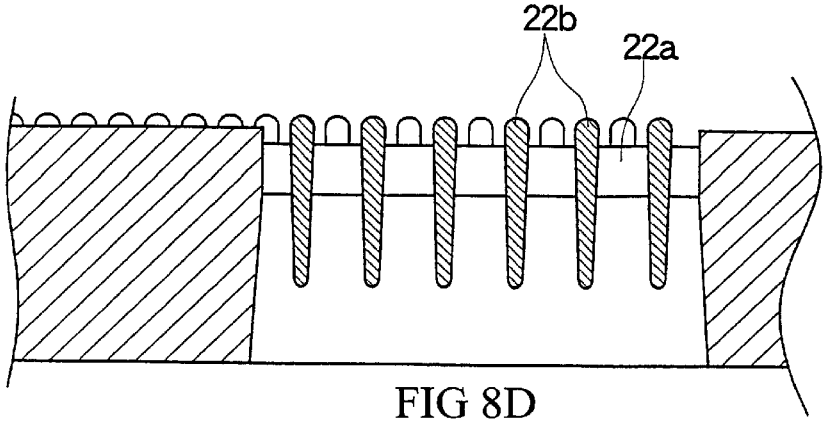

Slider 22 is preferably provided with a plurality, such as eight, support portions 22*c* projecting upwardly at the four corners of its upper surface (Refer to FIGS. 8A, 8C). Upon elevation of slider 22, support portions 22*c* project above the surface of adapter 24, fixed on base 12, as shown in FIG. 4 to be positioned above the tip portions of each contact member 14. The mounting seat for an IC 100 that has been inserted into adapter 24 is formed by the upper surface of the projecting support portions 22*c* that have been elevated, the seating being defined by adapter 24. Adapter 24 makes it possible for an IC 100 to be placed and guided to its seat by inclined walls, with the lower portion of the adapter being opened to provide access to the tips of the contact members 14 which extend from below. An IC 100 is carried into adapter 24 when the slider 22 is located at the top as shown in FIG. 4 and placed on protruding support portions 22*c*. Each solder ball 102 of IC 100 is nipped by the open tip portions of a respective contact member 14 as the slider, and concomitantly support portions 22*c*, are lowered to establish electrical contact therewith.

Socket 10 is further provided with a pair of latches 26 for clamping an IC 100 seated in adapter 24. Each latch 26 is made of electrically insulating material such as plastic, for example, having a selected width that extends along one side of IC 100 (refer to FIG. 1A) and with its front profile shaped like the claw of a crab (refer to FIGS. 2 and 4). Latches 26 are arranged to face each other along two opposing sides of IC 100 as shown in FIGS. 2 and 4 and are rotatably supported by respective shafts 28 on base 12. Because of its rotation, each latch 26 has its tip portion 26*a* move into adapter 24 through a respective aperture 24*a* formed in a wall of the adapter. In other words, latches 26 clamp IC 100 from above by tip portions 26*a* in the closed state shown in FIG. 2. In the open state shown in FIG. 4, moreover, tip portions 26*a* of latch 26 have moved away from adapter 24, thereby making it possible for an IC 100 to be placed in or taken out of adapter 24. Each latch 26 is continually biased by a coil spring 30 in the direction of being closed and is opened by movement of a respective arm 32*a* formed on cover 32 as will be described infra.

Figure 3:
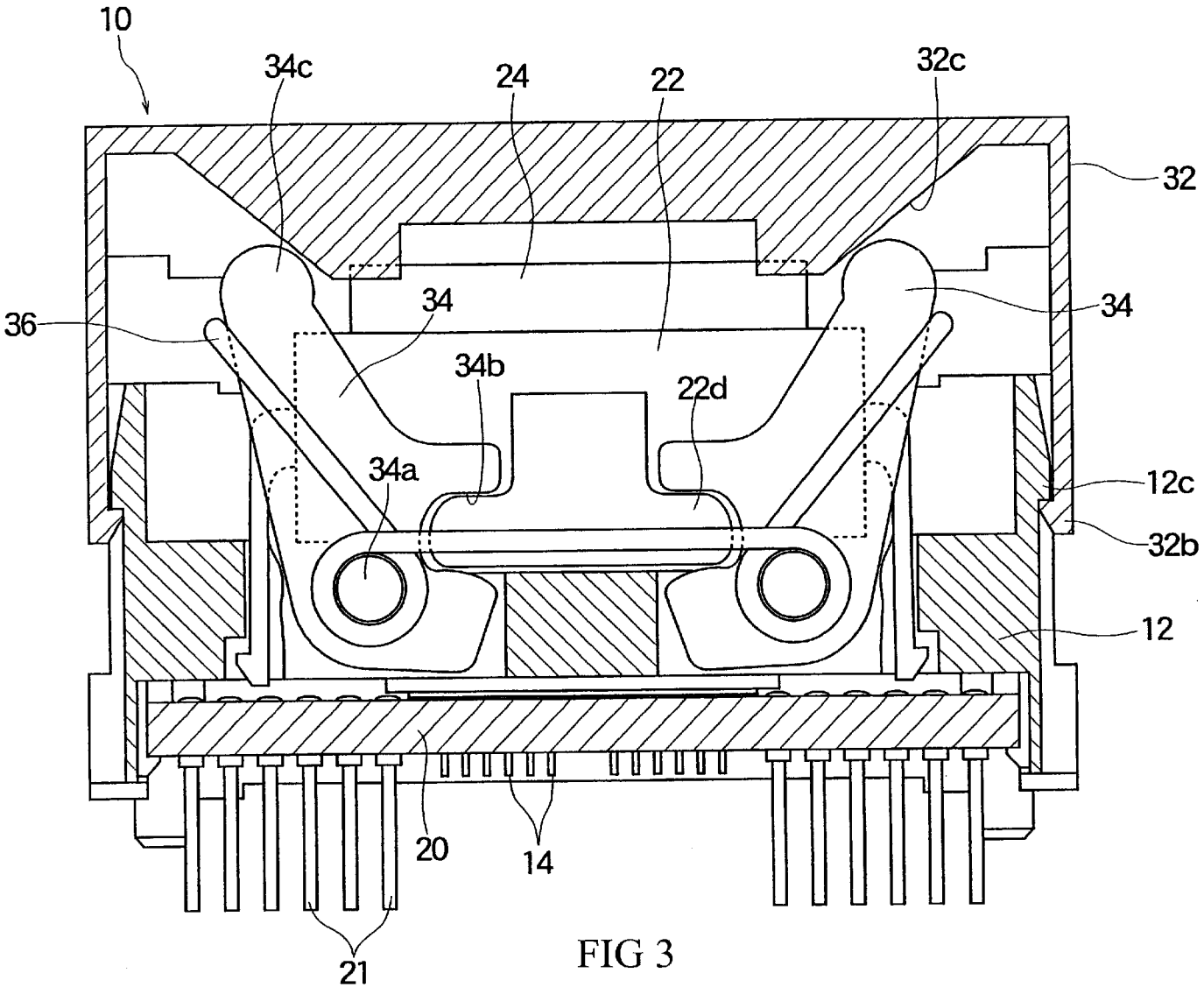
FIG. 3 is a cross sectional view taken on line 3—3 of FIG. 1A shown in the FIG. 2 state with the IC mounted therein.
Figure 5:
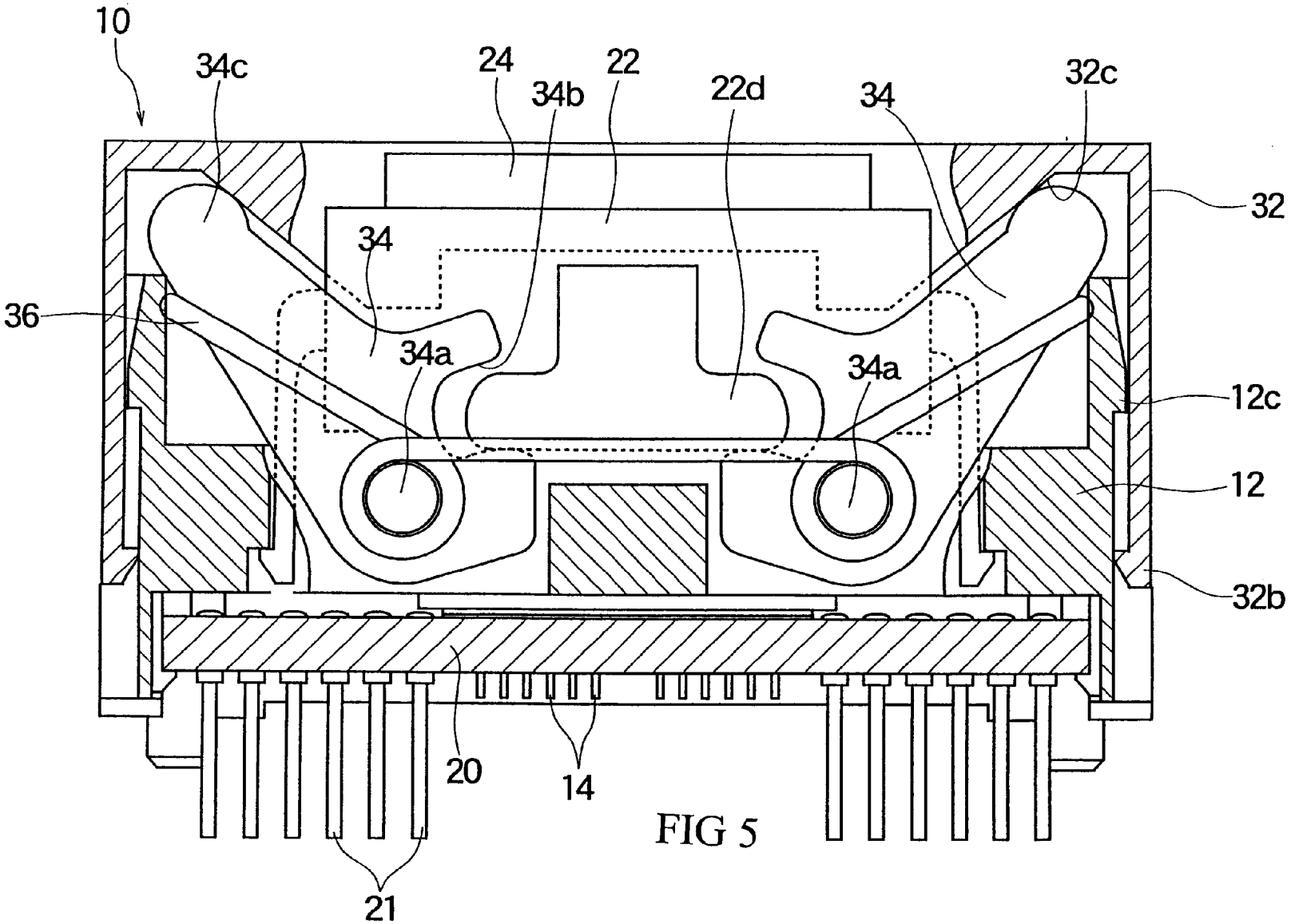
FIG. 5 is a cross sectional view on line 2—2 of FIG. 1A shown in the FIG. 4 state where the IC has been released.

Socket 10 is further provided with a cover 32 and an operating lever 34 (see FIGS. 3, 5). Cover 32 is formed in a shape complimentary to base 12, e.g., square shaped, of electrically insulating material such as plastic, for instance, and covers the top of base 12. An opening 32*d* is formed at the center of cover 32, where IC 100 can be either placed into or taken out from the top of adapter 24 (reference to FIGS. 1, 2 and 4). Cover 32 is supported to move upwardly and downwardly at a prescribed stroke relative to base 12 as shown in FIGS. 2 through 5. When cover 32 has been raised by the force of a spring, to be explained below (in the state shown in FIGS. 2 and 3), engagement part 32*b* at the bottom of the periphery of the cover is engaged with engagement part 12*c* on the side of base 12, with a consequence that its uppermost position is determined. As mentioned above, cover 32 is provided with arms 32*a* for the opening and closing operation of each latch 26 in conformity with its vertical movement. Arms 32*a* extend from the lower surface of cover 32 toward the back of each latch 26. When cover 32 is pushed down to its lower position as shown in FIG. 4, the distal end of each arm 32*a* pushes down surface 26*b* of a latch 26, thereby rotating the latch in the direction of being opened in opposition to coil spring 30.

Operating levers 34 are provided for moving slider 22 between elevated and lowered positions by lever action in conformity with the vertical movement of cover 32 as shown in FIGS. 3 and 5. The movement of slider 22 leads to the opening and closing operation of the tip portions of contact members 14. Levers 34 are rotatably supported with fulcrums 34*a* attached to base 12 as their centers. Each operating lever 34 is formed with a recessed portion 34*b* which engages with a respective protrusion 22*d* formed on opposite side of slider 22. Operating levers 34 are biased by respective springs 36 toward upright orientations as shown in FIG. 3. In this state, the upper surfaces of the recessed portions 34*b* push down on protrusions 22*d*, with a result that the slider 22 is brought into a lowered position. When a force is applied to action points 34*c* of operating levers 34 by cover 32, meanwhile, action points 34*c* are moved outwardly by the cam action of the action points on surfaces 32*c* on cover 32 to rotate operating levers 34 in the opposite direction in opposition to the force of springs 36. When this occurs, the lower surface of the recessed portions 34*b* push up on protrusions 22*d*, with a result that slider 22 is moved to an elevated position.

When there is no outside force applied to cover 32, socket 10 is in the state shown in FIGS. 2 and 3. (It is assumed for the purpose of this explanation that there is no IC 100 mounted on the socket.) In this state, cover 32 is moved upward by the force of operating levers 34 due to springs 36, with the latches being closed. When cover 32 is pushed down to the base by the action of an automatic unit, not shown in the drawing, action points 34*c* of operating levers 34 are pushed down by inclined surfaces 32*c* of cover 32 as shown in FIG. 3, with operating levers 34 moving outward in opposition to the force of spring 36. As shown in FIG. 5, slider 22 moves upward as protrusions 22*d* are raised by the lower surfaces of recessed portions 34*b* because of the rotation of operating levers 34.

As will be explained in detail infra, the bifurcated tip portions of contact members 14 are opened by upward movement of slider cores 22*b* which accompany the elevation of slider 22, thereby making it possible for solder balls 102 of an IC 100 to be received between the tips of respective contact makers. Because of the elevation of slider 22, mounting portions 22*c* protrude upward from the surface of adapter 24. As a result, it becomes possible for an IC 100 to be mounted. In socket 10 of this embodiment, latches 26 are opened to receive an IC 100 along with the opening contact members 14. In other words, when cover 32 is lowered from the state shown in FIG. 2, arms 32*a* which extend from the cover's lower surface engage respective surfaces 26*b* of latches 26 as shown in FIG. 4, thereby lowering them. Because of this, latches 26 rotate outwardly in opposition to the force of coil springs 30. Because of the outward rotation of latches 26, their tip portions 26*a* move away from the surface of adapter 24, thereby making it possible for an IC 100 to be inserted. In the state shown in FIGS. 4 and 5 in which latches 26 and the tips of contact members 14 are open, an IC 100 is placed into adapter 24 through opening 32*d* of cover 32. An IC 100 is placed on protruding mounting portions 22*c* of slider 22 inside adapter 24. At this juncture, each solder ball 102 of the IC is located above the opened tip portions of a corresponding contact member 14. When the downward force applied to cover 32 is removed, cover 32 rises and operating levers 34 assume an upright orientation due to springs 36, as seen in FIG. 5, with a result that slider 22 is pressed downward as shown in FIG. 3. Along with the downward movement of slider 22, its protruding mounting portions 22*c* recede from the surface of adapter 24 as shown in FIG. 2. Because of this, IC 100 moves slightly downward and solder balls 102 are positioned between the tip portions of respective contact members. As the slider core 12*b* is lowered, the top of contact members 14 become free, thereby nipping each solder ball 102 by their elastic force so as to effect electrical connection therewith.

When the downward force on cover 32 is removed and cover 32 is raised by operating levers 34, arms 32*a* separate from latches 26. As a consequence of this, latches 26 rotate in the closing direction by the force of coil springs 30. As a result, the tip portions 26*a* of the latches move into adapter 24, thereby holding IC 100 from above. As a result of what has been described above, IC 100 will be clamped in socket 10, with the solder balls 102 in electrical contact with respective contact members 14.

Figure 6:
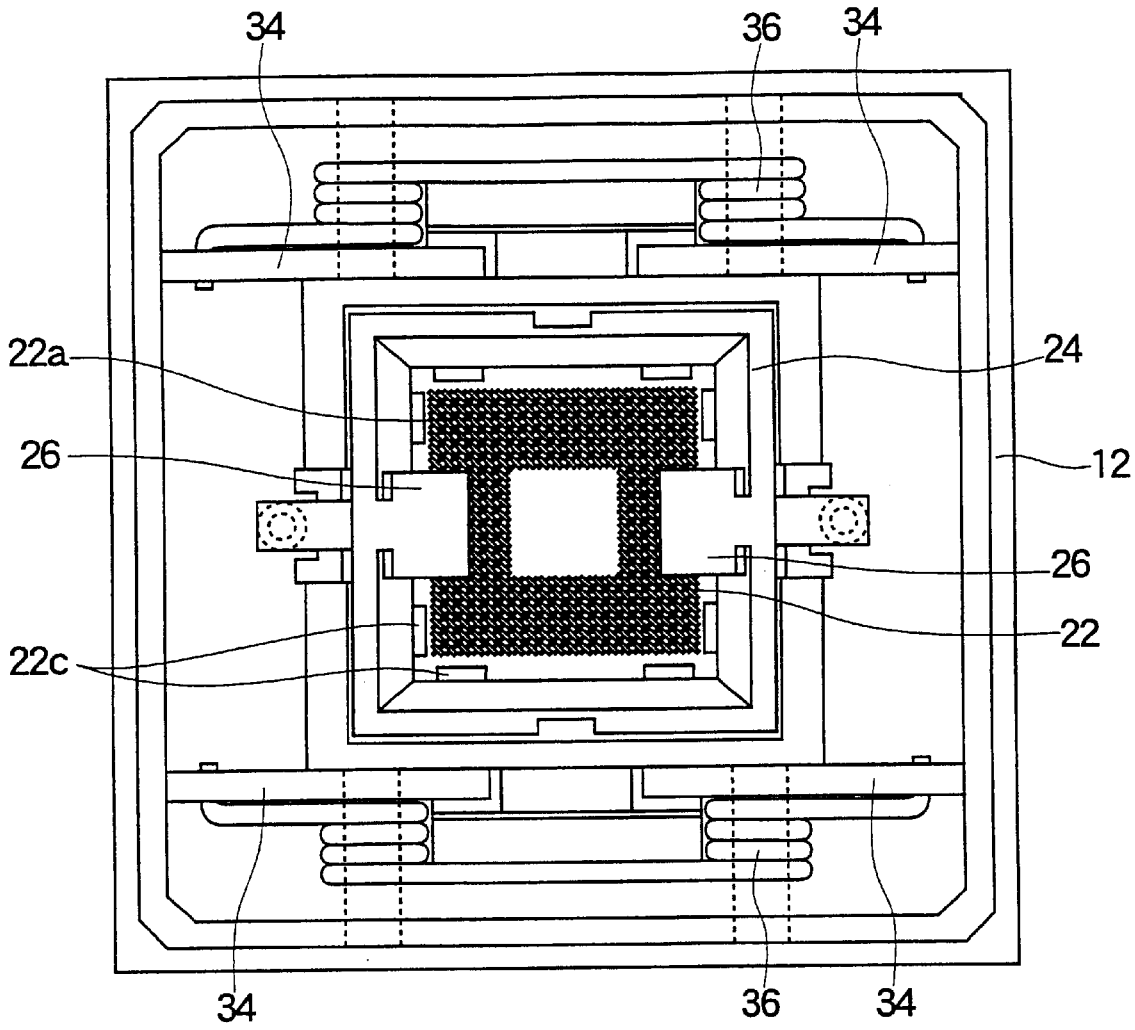
FIG. 6 is a top plan view of the socket according to the invention with the cover removed.

FIG. 6 is a top plan view of socket 10 with cover 32 removed, showing slider 22, adapter 24, a pair of latches 26 on two opposites sides and operating levers 34. This figure clarifies the positional relationship among these components. IC 100 is inserted through opening 32*d* of the removed cover 32, into the region which is surrounded by the adapter 24 and toward the surface of slider 22. Protruding mounting portions 22*c* extend upward from slider 22 and the periphery of the lower surface of IC 100 is placed thereon.

Figure 7:
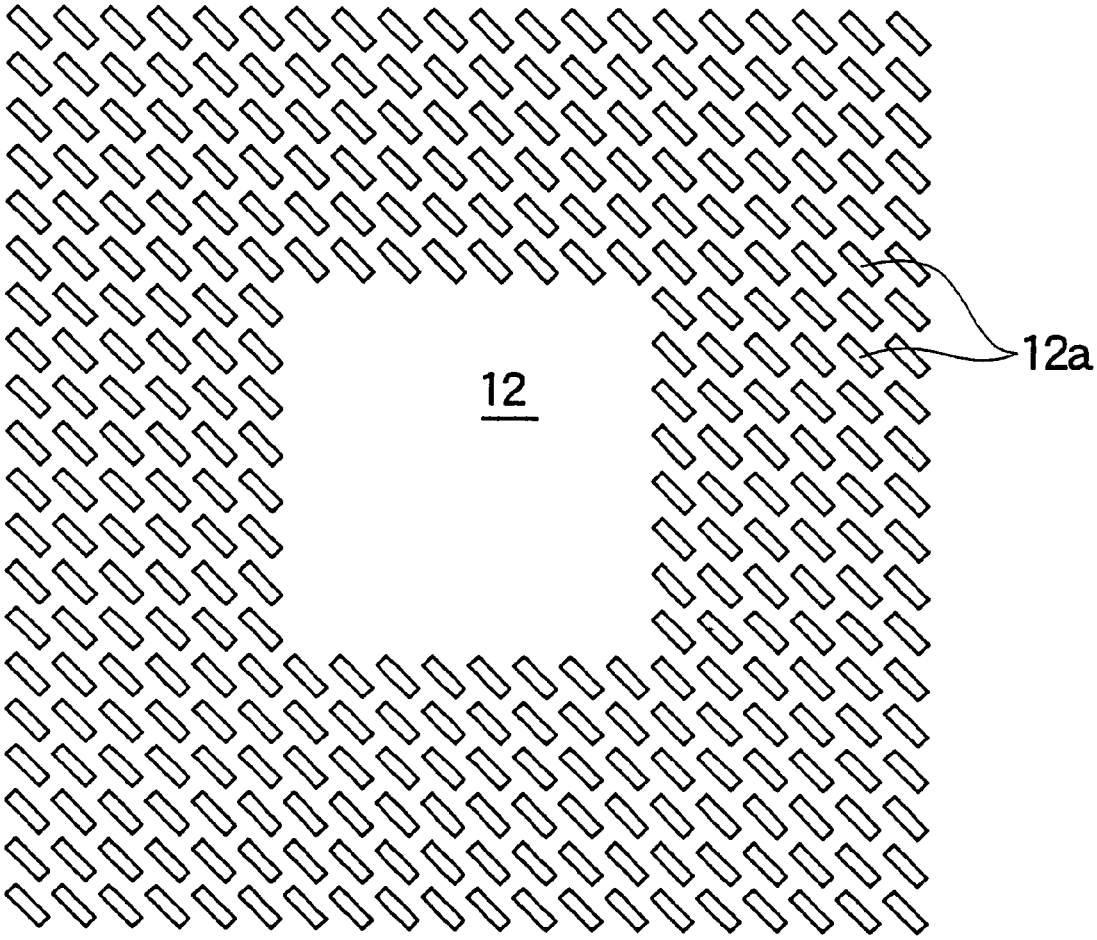
FIG. 7 is a top plan view of an arrangement of through holes formed in the base.

FIG. 7 shows the arrangement of through holes 12*a* formed in base 12. As shown in this figure, each through hole 12*a* extends in an inclined direction relative to the sides of the base, thereby guiding each contact member 14 that is inserted therein along the inclined direction. In other words, each contact member 14 is inserted so that its bifurcated tip portions will open or close along the longitudinal direction of through holes 12*a*. The arrangement of the obliquely formed through holes 12*a* with contact members 14 similarly arranged provides an advantage of a stroke which is suitable for the opening and closing of the tips of each contact member 14. It is within the purview of the invention, however, to arrange the through holes in a direction where they extend in parallel with the sides of the base, if desired.

Figure 9:
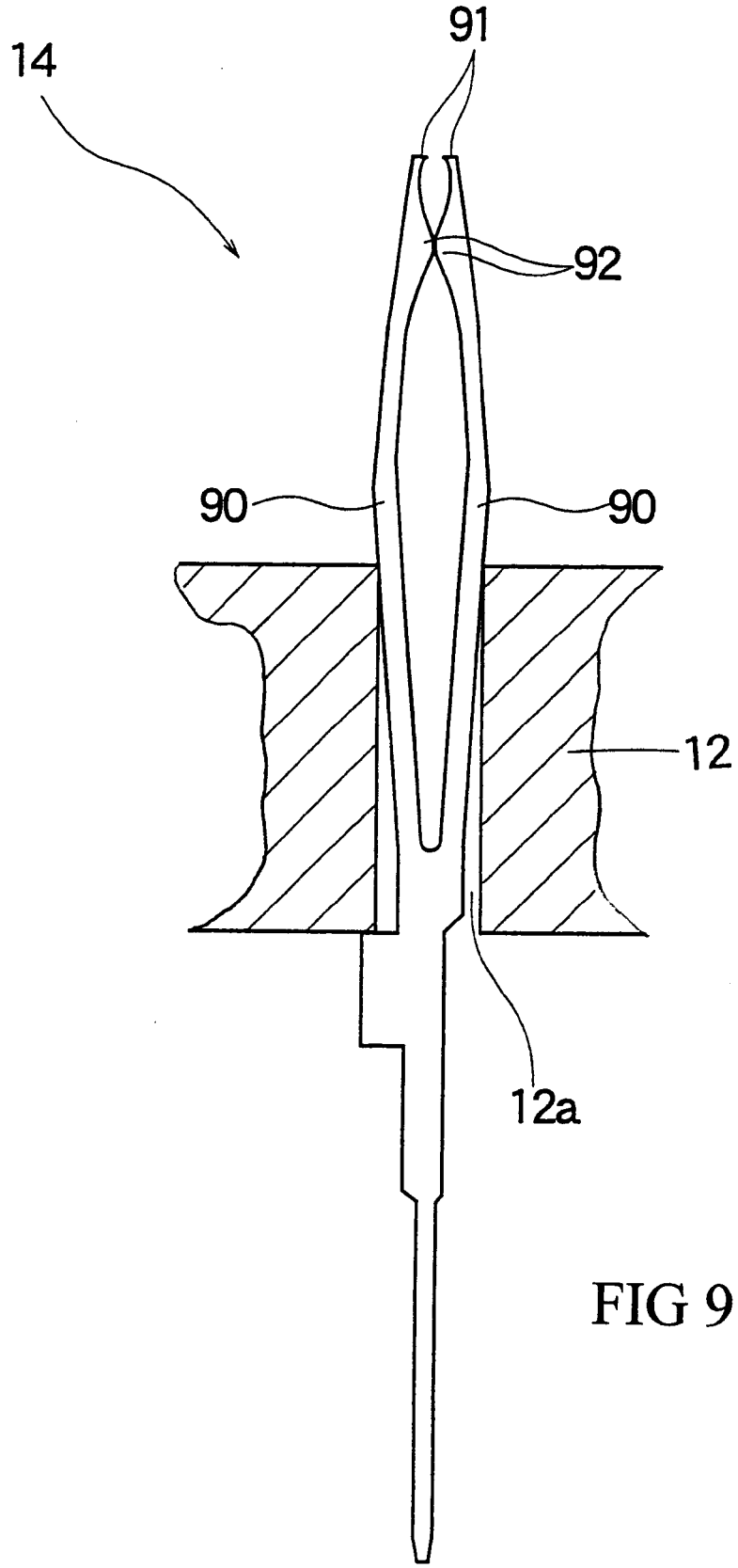
FIG. 9 is an enlarged side view of a contact member mounted in a through hole in the base of the socket.
Figure 10A:
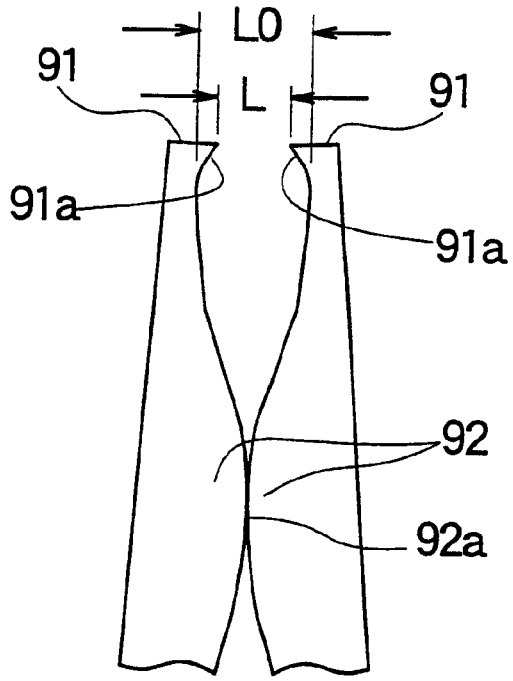
FIGS. 10A and 10B are further enlarged views of the tip portions of a contact member with FIG. 10A showing the closed position when no IC is loaded in the socket and FIG. 10B showing the closed position when an IC is loaded, that is, a contacts engaged position.
Figure 10B:
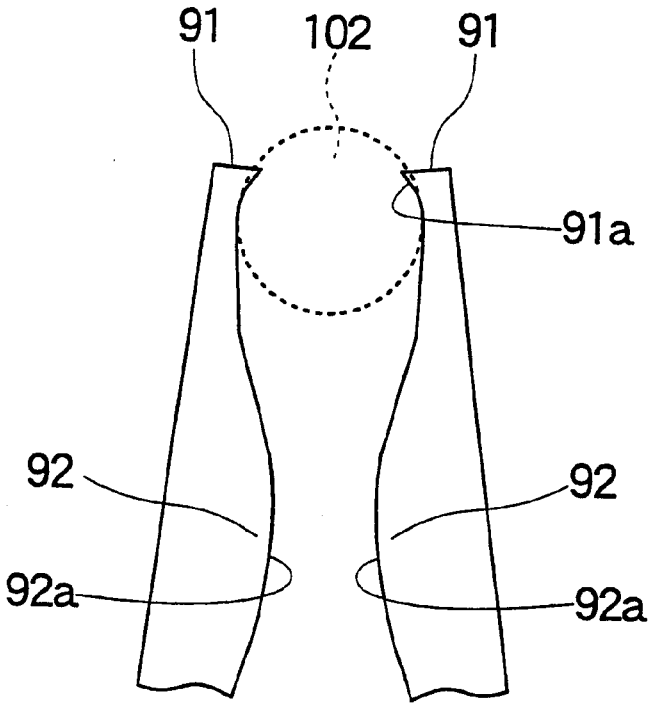

The specific structure and operation of contact members 14 will be explained below by referring to FIGS. 9 through 12. As shown in FIGS. 9 and 10, the upper half of contact member 14 is bifurcated, with its tip portions holding a solder ball 102 of IC 100 so as to effect electrical contact therewith. In a preferred embodiment, contact members 14 can be prepared by punching them out of an electrically conductive plate such as a plate of a copper alloy, followed by gold plating. Hereafter, that portion of the contact member which has been bifurcated will be called arms 90 and 90. In the stage where they are formed, arms 90 and 90 have their tip portions opened; however, they are closed as the lower portion of the arms 90 are pressed toward each other when the lower half of the base is pressed into through hole 12*a* of the base. (Refer to the state shown in FIGS. 9 and 10A.) A laterally extending, protruding end 91 is formed at the tip portion of each arm 90 extending toward the other arm. Contact members 14 engage solder balls 102 on their inner or contact surface 91*a*. In other words, contact members 14 contact the spherical solder balls 102 in the area ranging from the position of the maximum diameter part of solder balls 102 to the base of the IC. This method of effecting contact on the base side of the maximum diameter part of the solder balls, even if there is some positional dislocation of the solder balls, guarantees a stable effective electrical engagement of the contact members 14 in the same manner as solder balls 102 without any positional dislocation and, at the same time, prevents any possible deformation of the lower surface of the solder balls that could be produced in the case where contact is effected at the maximum diameter part of the solder ball or at a position which is more toward the outer tip portion of the solder balls.

Each arm 90 of contact members 14 is provided with a convex portion 92 adjacent to the lower portion of the tip portion and aligned with opposing convex portion 92 of the other arm of a respective contact member. The convex parts 92 engage each other at the butting surfaces 92*a* when the arms 90 are closed (in the state shown in FIG. 10A), thereby securing the minimum spacing distance L between the tip portions of the arms. The minimum spacing distance L of the arms prevents excess stress from being exerted on a solder ball. Electrical engagement of the tip portions with the solder balls 102 is assured while at the same time possible damage to the solder balls by the contact members is prevented. In a preferred embodiment, the minimum spacing distance L is desirably in the range between approximately 0.14 and 0.20 mm when the diameter of the solder balls is 0.25 millimeters. The distance L0 of the arms at the position corresponding to the diameter of the solder balls is desirably more than 0.25 mm. While reducing the minimum spacing distance L to less than the diameter of the solder ball in this manner, the distance L0 of the position corresponding to the diameter of the solder ball is made greater than that, thereby making is possible to assure contact engagement at the position of contact surface 91*a* without effecting contact engagement at the position of distance L0. Accordingly, any deformation of the lower surface of the solder ball can be prevented.

Figure 11A:
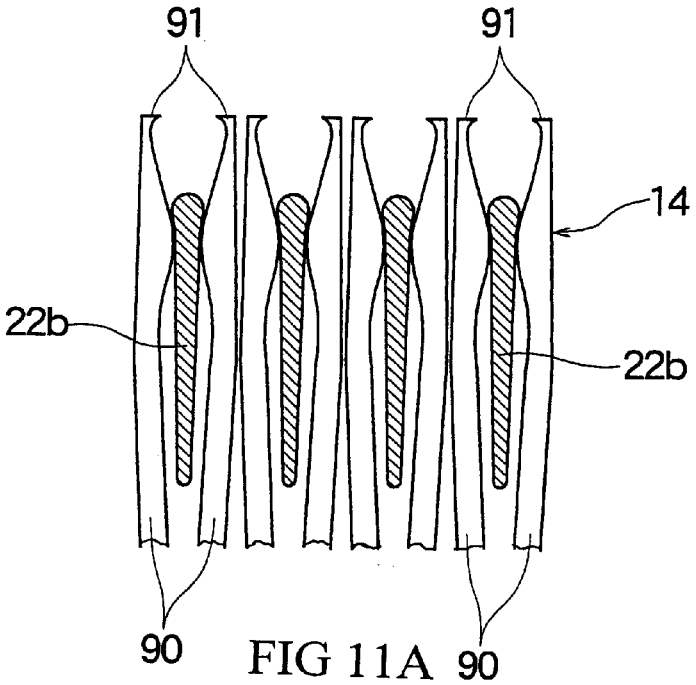
FIGS. 11A and 11B are figures shown for the purpose of explaining the operation of the contact members by the slider core and shown in the open and contacts engaged positions.
Figure 11B:
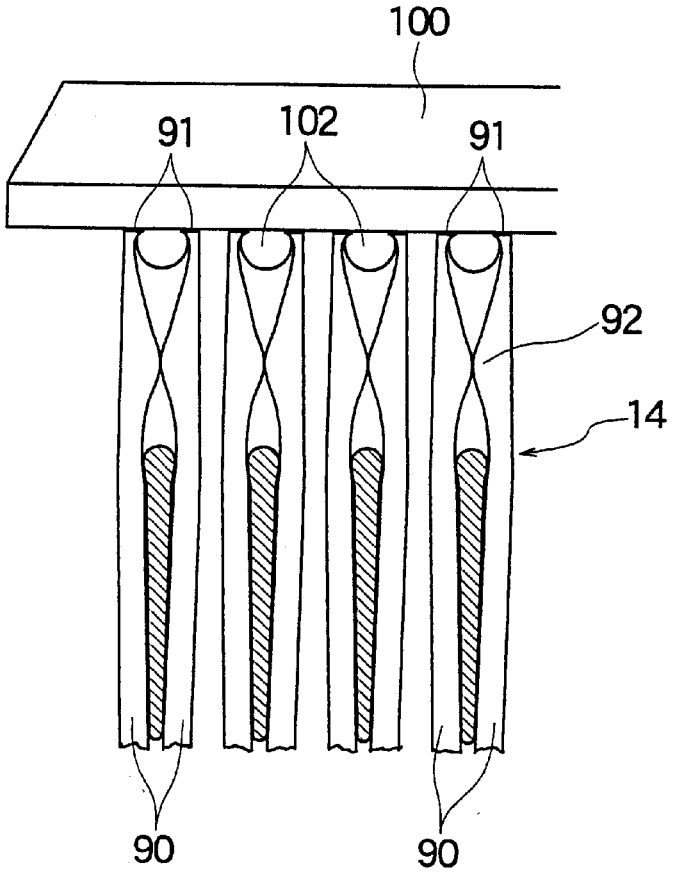

FIGS. 11A, 11B illustrate how contact members 14 are opened and closed by slider cores 22*b* of slider 22. A respective core 22*b* is disposed between arms 90 and 90 of each contact member 14 and the tip portions of the contact member are opened or closed in conformity with the horizontal motion that accompanies the vertical movement of slider 22 as described above. In other words, slider cores 22*b*, when moved to an upper position as shown in FIG. 11A, have their upper parts move between convex parts 92, with a result that the tip portions of the contact members 14, i.e., tips 91, are opened. In this state, IC 100 is placed over contact members 14. Slider cores 22*b* will then have their top portions move down from respective convex portions 92 when they are moved to the lower position as shown in FIG. 11B. As the slider cores 22*b* gradually slip away from the convex portions 92, the arms start approaching each other by their spring force, with tips 91 of each contact member nipping the lowered respective solder ball 102 of IC 100 from opposite sides thereof.

Figure 12A:
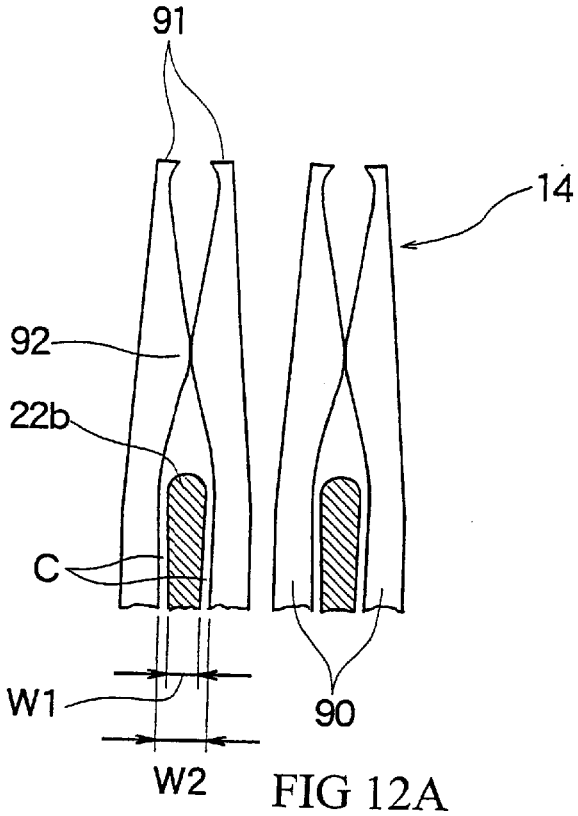
FIGS. 12A and 12B are figures shown for the purpose of explaining the clearance of the slider core relative to the contact members and shown in the closed (without an IC) and contacts engaged (loaded with an IC) positions, respectively.
Figure 12B:
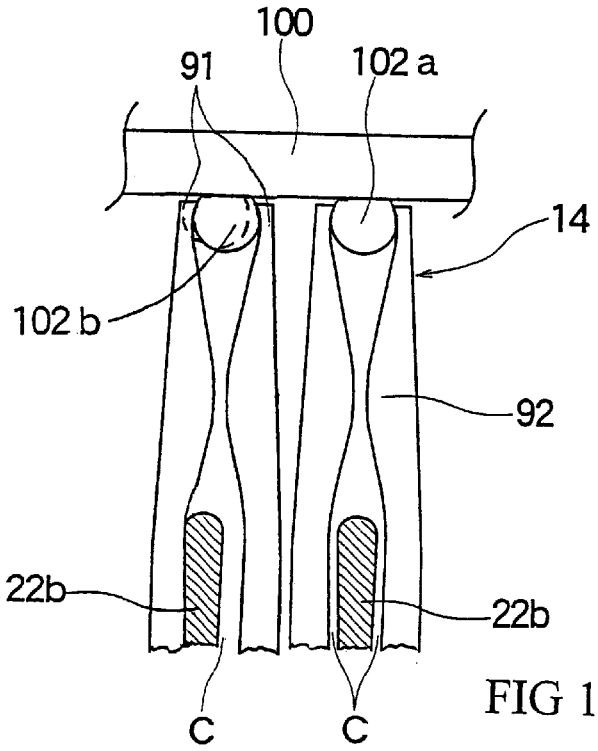

In the embodiment shown in FIGS. 12A, 12B, slider cores 22*b* are formed so that the maximum width W1 (the top part as seen in the drawings) is smaller than gap W2 at its corresponding position when arms 90 are closed, as shown in FIGS. 12A. As a result, a selected clearance is created on both sides of slider cores 22*b* when arms 90 are closed so that their tip portions can move to the right and left. Since the tip portions of contact members 14 are made to move as shown in FIG. 12B, contact members 14 can follow solder balls 102 which may have been dislocated as long as the position of the dislocated solder ball is within the space defined by the tip portions when in the opened position. In the presence of any dislocated solder ball 102*b* as compared to correctly arranged solder balls 102*a* as shown in same figure, contact member 14 moves to the side of solder ball 102*b* that has been positionally dislocated within the range of movement that is given by the clearance, thereby effecting contact engagement therewith in that state. At this juncture, solder ball 102*b* receives an equal contact force on both opposite sides in spite of its positional dislocation. Accordingly, there will be no problem of insufficient contact on one side, with the contact force on the other side being excessive which could damage the solder ball.

Figure 13A:
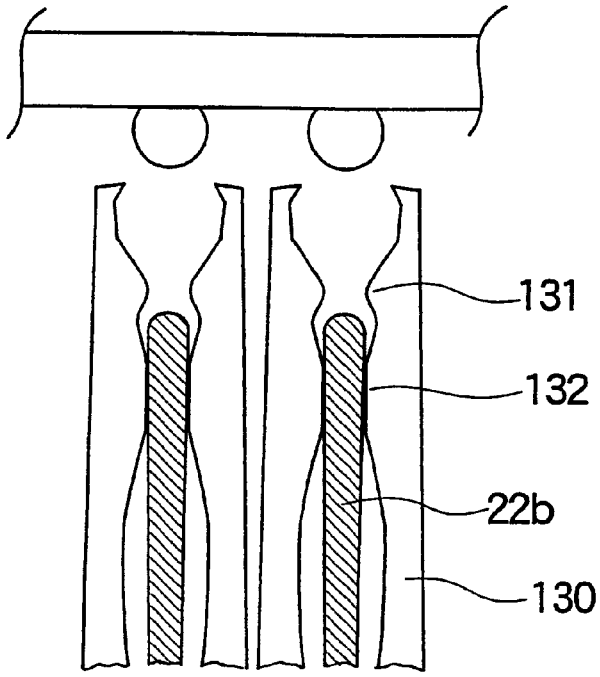
FIGS. 13A and 13B show another embodiment of the contact members in the open and contacts engaged positions, respectively.
Figure 13B:
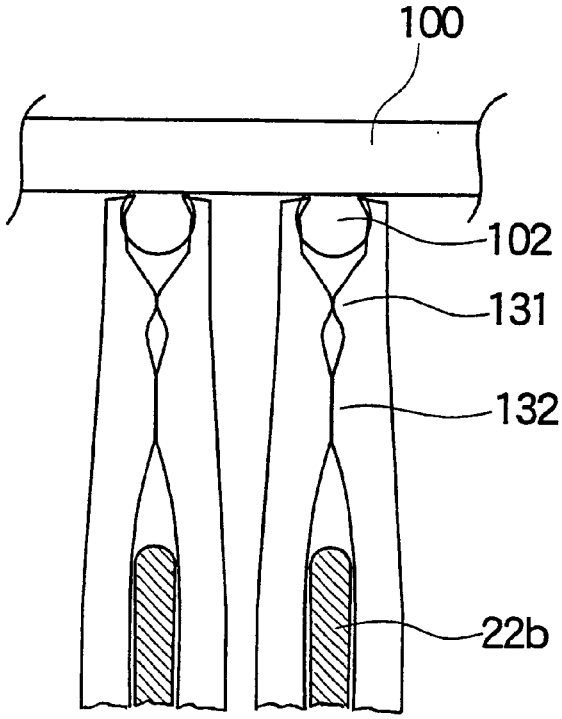

FIGS. 13A, 13B illustrate modifications in the structure of the contact makers. Arms 130 of the contact members according to this embodiment are provided with first convex portions 131 and second convex portions 132 which correspond to convex portions 92 of arms 90. In this case, the minimum spacing distance of the tips of the contact members 14 are determined by first convex portions 131, with contact being effected with slider core 22*b* at the second convex portions 132. According to this embodiment, it becomes possible to secure a certain clearance between arms 130 and a respective slider core 22*b* and adjust the maximum spacing distance of the tips of the contact members by adjusting the distance between the second convex parts 132 in the design stage (it is possible for the second convex portions to be separated from each other when the arms are closed) as has been explained above.

Figure 14A:
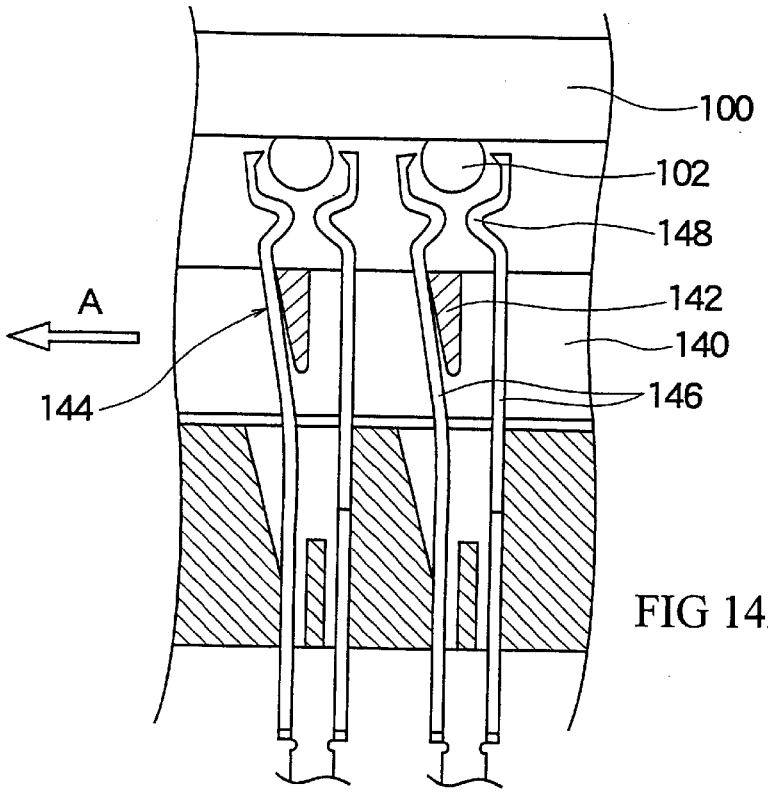
FIGS. 14A and 14B are views showing another embodiment of the slider that opens (FIG. 14A) or closes (FIG. 14B) the contact member.
Figure 14B:
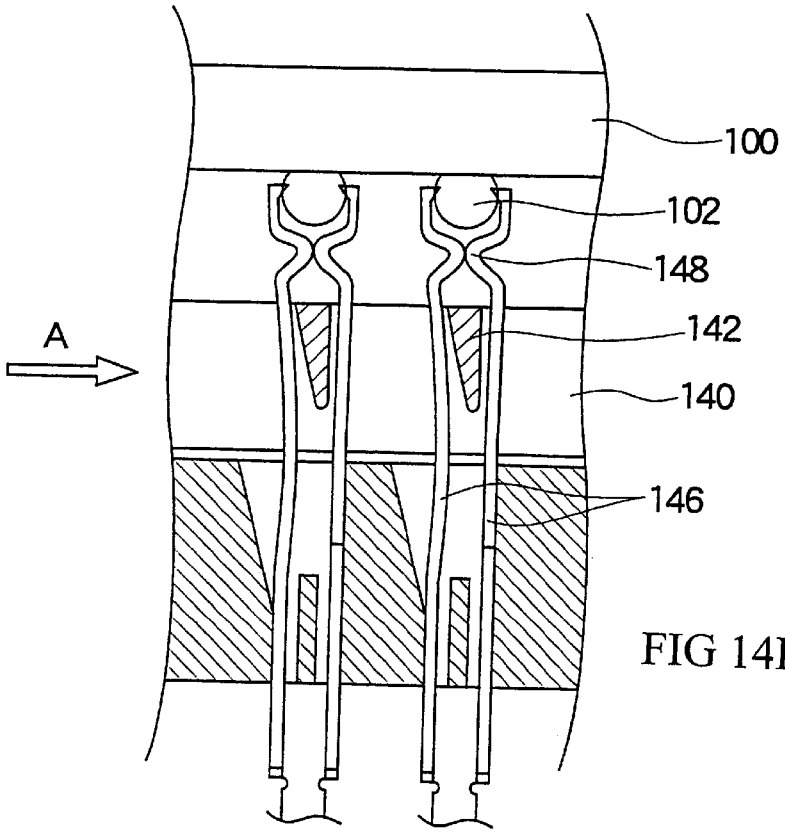

FIGS. 14A, 14B illustrate another embodiment of the structure of the slider that opens or closes the contact members. Slider 40 and slider cores 142 according to this embodiment are formed to move in a direction (indicated by arrow A marked in the figure) that crosses the direction along which contact members 144 extend. As the slider 140 moves in the left direction shown in FIG. 14A, slider cores 142 move one of the arms 146 of each contact member 144 outwardly. Because of this, the tip portion of each arm 146 opens, thereby making it possible for a solder ball 102 of the IC to be received. When slider 140 is returned to the initial position from that shown in FIG. 14A to that shown in FIG. 14B (moved in the right direction), arms 146 nip solder balls 102 of the IC from opposite sides by spring force, thereby effecting electrical contact therewith. Contact members 144 shown in these figures have also been modified. Contact members 144 are formed by punching them out of a suitable metal plate, followed by bending upper longitudinally extending opposite sides to face each other forming arms 146. Convex portions 148 determine the minimum spacing distance of the tip of the contact members and are formed by bending the corresponding locations of arms 146.

Figure 15:
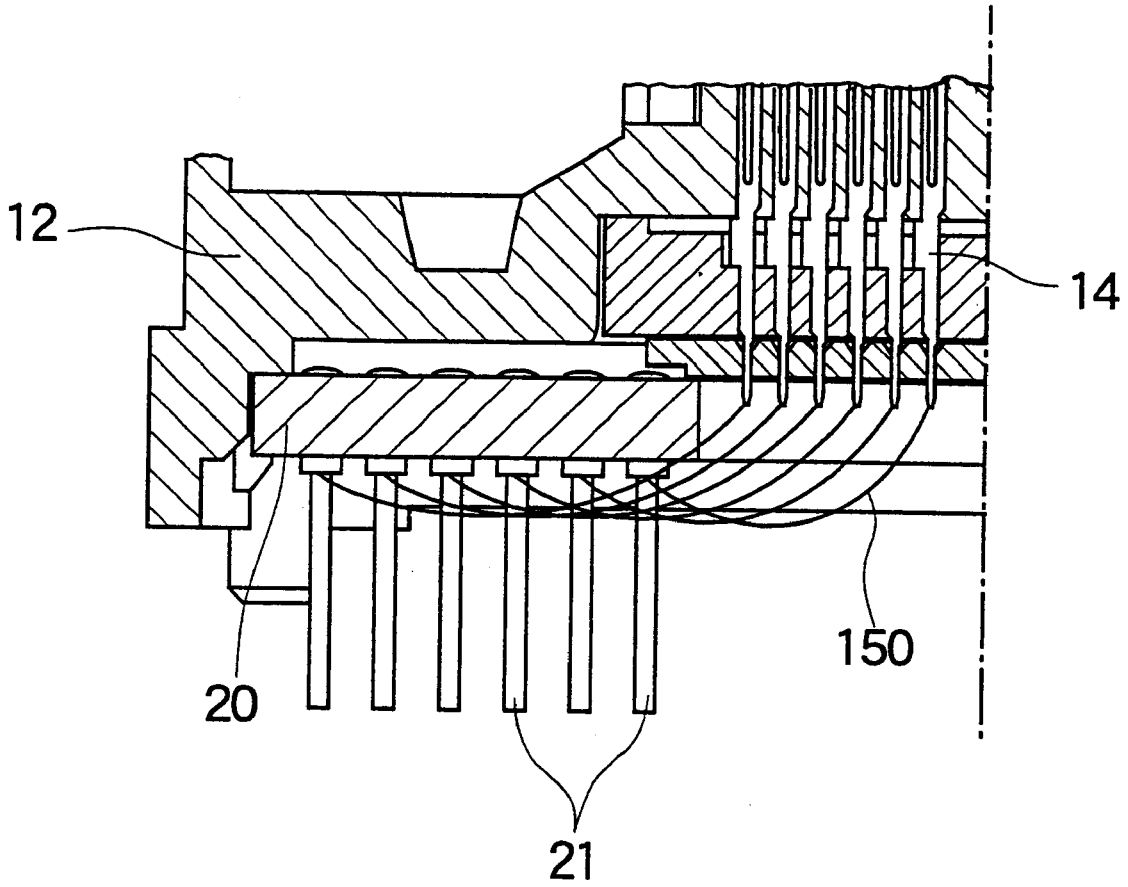
FIG. 15 shows another embodiment of the invention showing an alternative arrangement for the contact members of a narrow pitch arrangement which are connectable to conductive portions on a printed substrate (not shown) spaced further apart than the contact members.
Figure 16A:
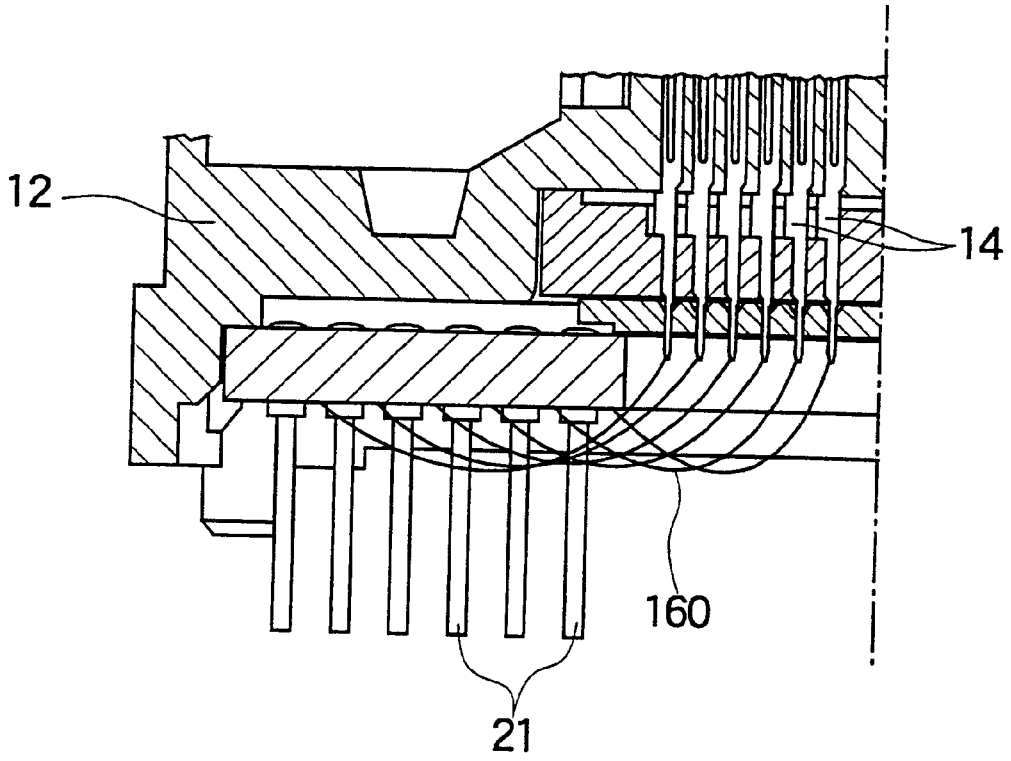
FIGS. 16A and 16B are cross sectional and bottom plan views, respectively, showing another embodiment of the invention in which the contact members of a narrow pitch arrangement are connected to the conductive portions on a printed substrate (not shown) spaced further apart than the contact members.
Figure 16B:
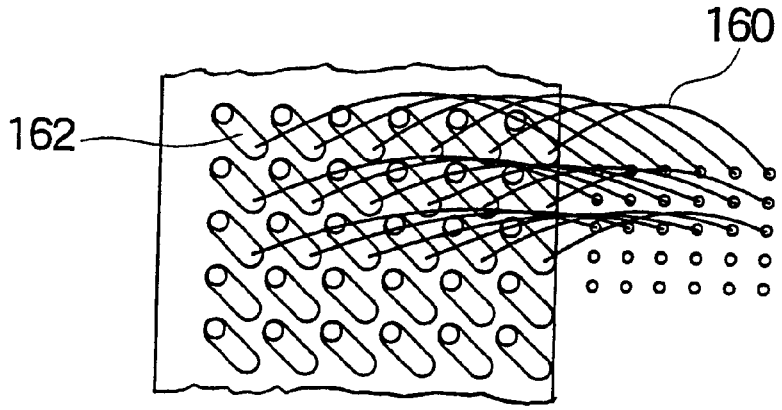

FIGS. 15 through 22 show other embodiments which include a connector for connecting contact members 14 that have been arranged in a narrow pitch to conductive pads on the printed substrate (not shown) having a greater pitch. FIGS. 15 and 16A, 16B show an embodiment in which contact members 14 and socket terminals 21 for mounting the socket on a printed substrate are connected by using conductor wires 150 and 160 in place of the wiring pattern on expansion board 20 in the previous embodiment. In the embodiment shown in FIG. 15, one end of conductor wires 150 are directly connected to respective edges of terminals 21 and, in the embodiment shown in FIGS. 16A, 16B, one end of conductor wire 160 are connected to conductive pads 162 on expansion board 20. In these embodiments, the conductor wires are covered with a cap member or sealed by potting, etc.

Figure 17:
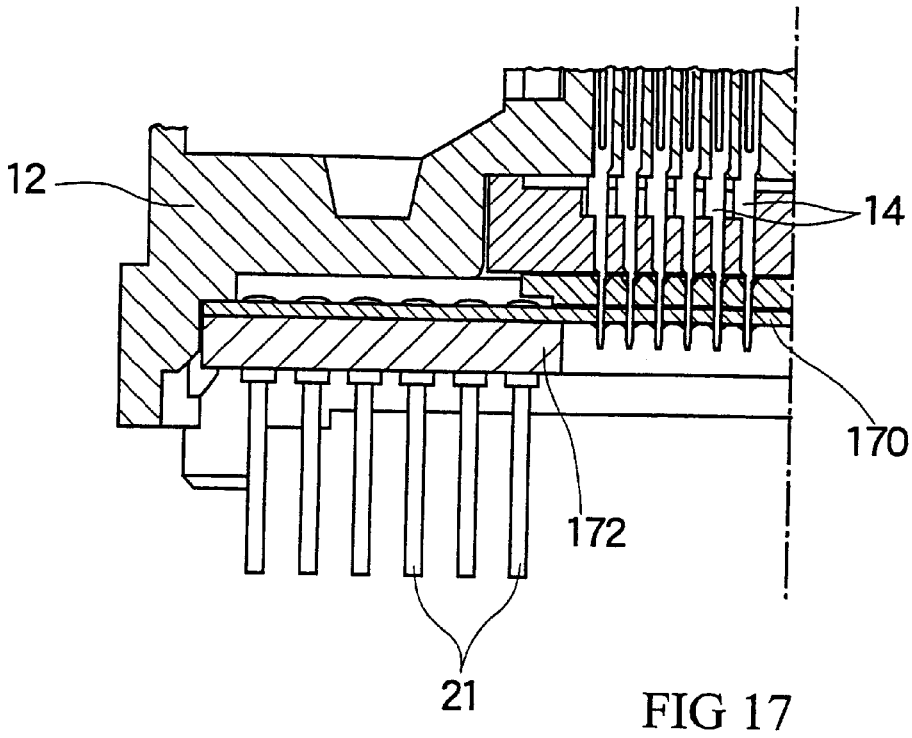
FIGS. 17–22 are cross sectional views showing alternative embodiments of the invention in which contact members having a narrow pitch arrangement are connected to conductive portions on a printed substrate (not shown) spaced further apart than the contact members.

FIG. 17 illustrates an embodiment in which a flexible printed substrate 170 is used in place of a relatively non-flexible expansion board 20 and contact members 14 and terminals 21 are connected through the wiring pattern on the substrate. A reinforcement member 172 is arranged on the lower surface of flexible printed substrate 170, with installation onto base 12 being achieved through it.

Figure 18:
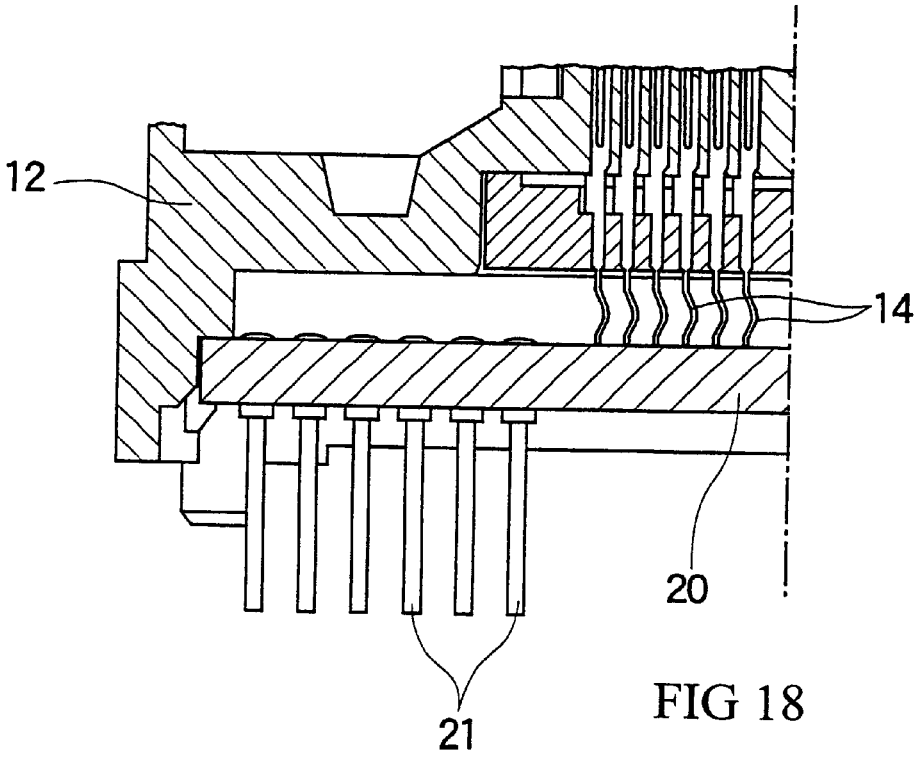

FIG. 18 illustrates an embodiment in which the ends of contact members 14 are pressed onto the wiring pattern of the expansion board 20 in the longitudinal direction of contact members 14 by using their elasticity, thereby effecting a connection between contact members 14 and terminals 21.

Figure 19:
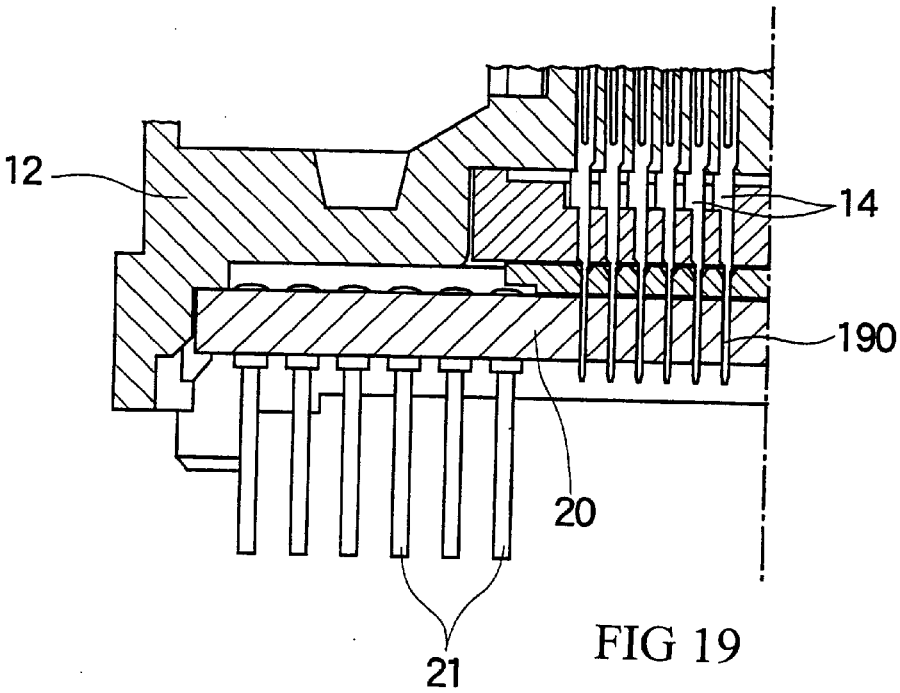
Figure 20:
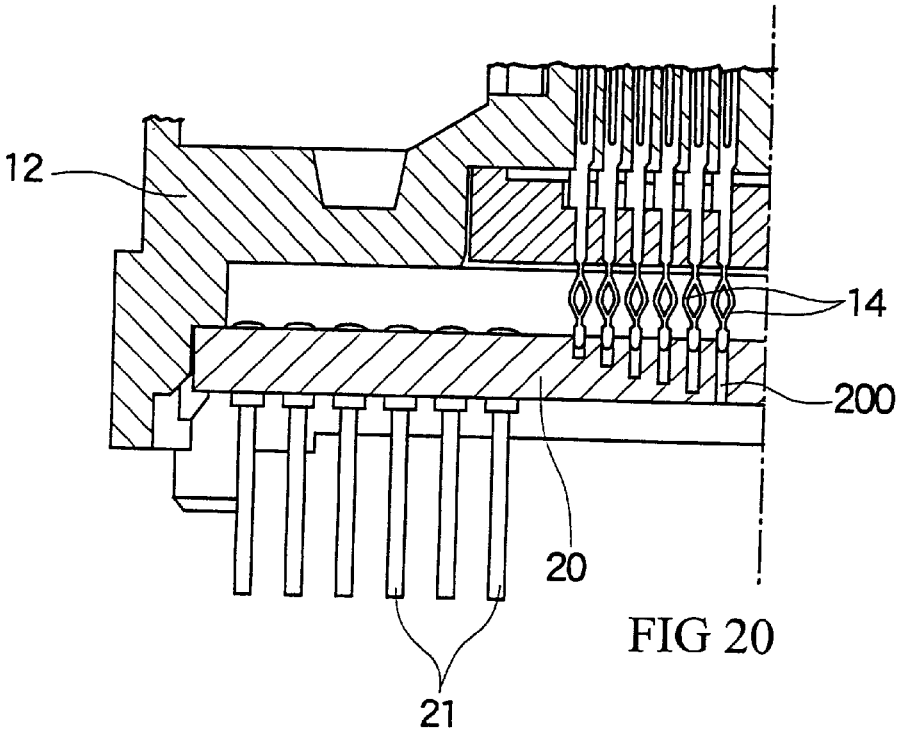

FIGS. 19 and 20 illustrate embodiments in which the lower end of each contact member 14 is compressively inserted into sockets 190 and 200 respectively, formed in the expansion board 20 (and which may be enhanced by soldering, if desired.) Terminals 21 are connected to the sockets through the wiring pattern on the board.

Figure 21:
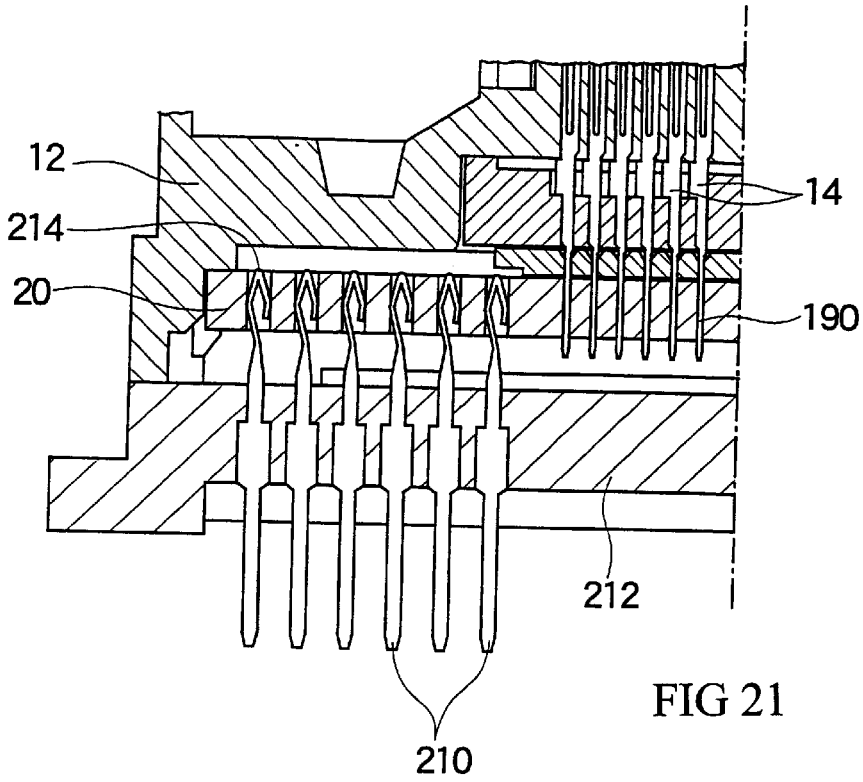

FIG. 21 illustrates an embodiment in which terminals 210 for substrate mounting is held on a support member 212 which is separate from expansion board 20, thereby making it possible to attach or detach socket 10 from the terminals. Terminals 210 are fixed to support member 212, with their V-shaped upper portions being inserted into sockets 214 of expansion board 20, thereby making it possible to effect electrical contact therewith. With support member 212 and terminals 210 mounted on a printed substrate (not shown), socket 10 is then attached thereto and detached therefrom.

Figure 22:
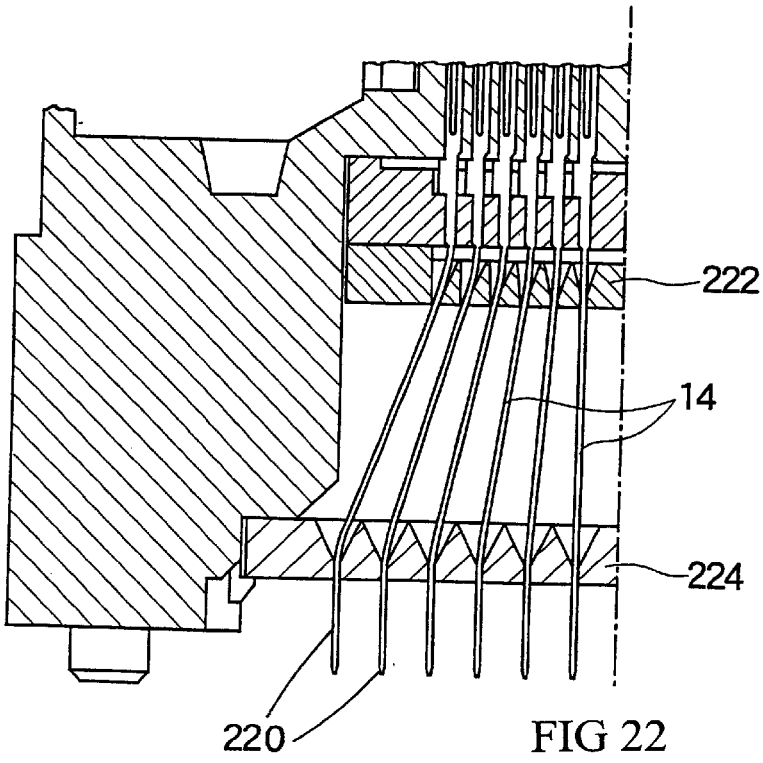
Figure 23:
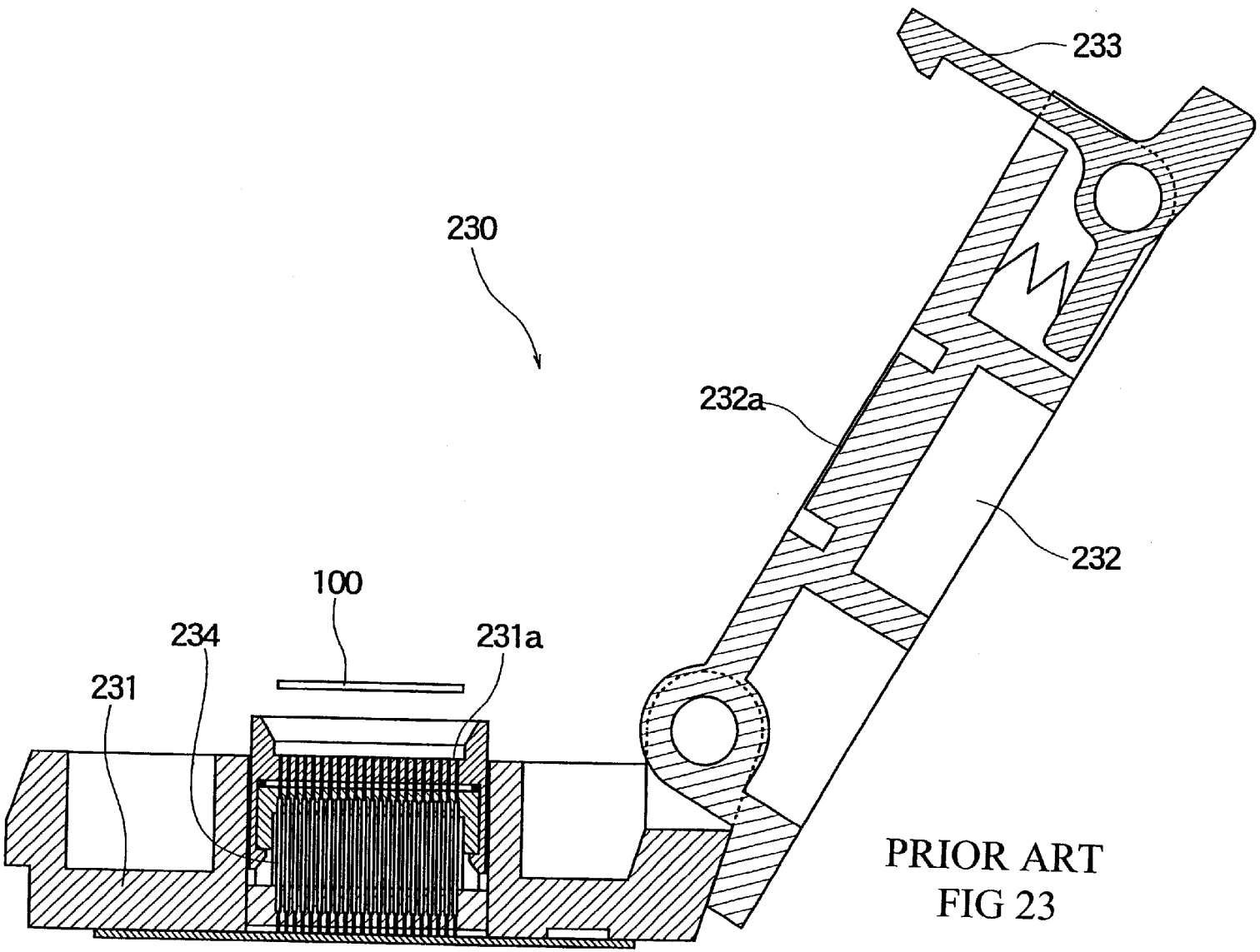
PRIOR ART FIG 23
FIG. 23 is a cross sectional view of a conventional socket shown with its cover opened.
Figure 24:
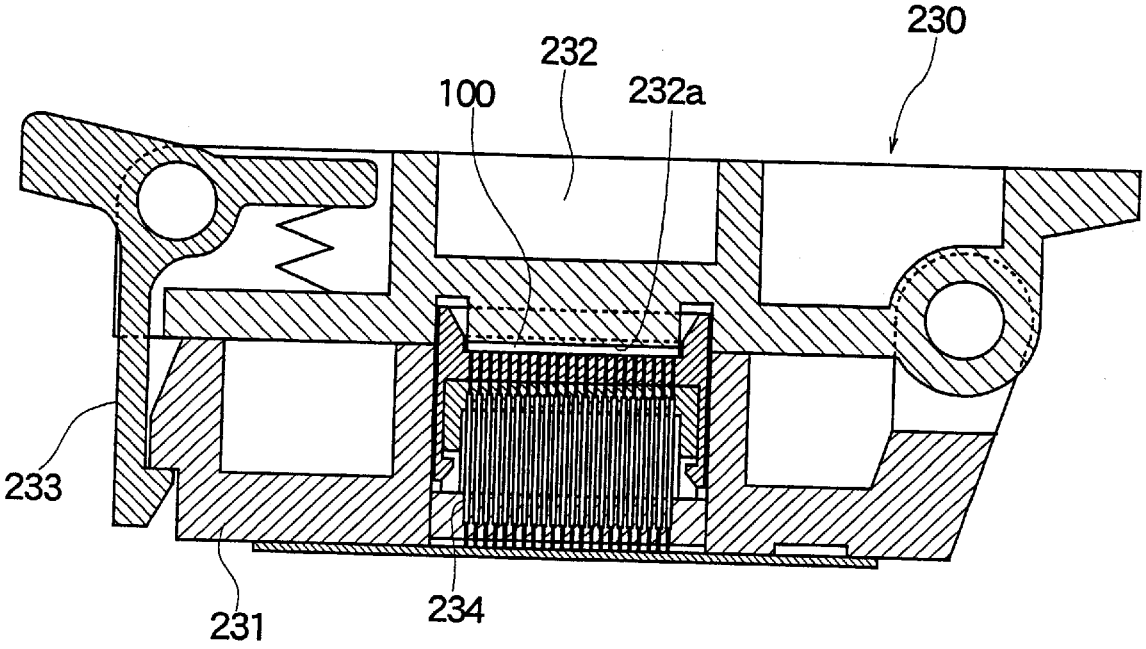
PRIOR ART FIG 24
FIG. 24 is a cross sectional view of the FIG. 23 socket shown with the cover closed.

FIG. 22 illustrates an embodiment in which contact members 14 are extended in length for direct connection to the printed substrate rather than using intermediate terminals for substrate mounting. The extended terminals 220 of contact member 14 convert the pitch in conformity with the traces on the printed substrate by means of two lead guides 222 and 224.

According to this invention which has been explained above, an essentially constant contact force is provided for each terminal of the IC, irrespective of the variations of the terminal installation or size. At the same time, possible damage inflicted to the terminals by the contact members is minimized. Additionally, the invention provides suitable structures for mounting ICs having terminals of a narrow pitch on a printed substrate on which terminal connections have a wider pitch.

It should be understood that although preferred embodiments of the invention have been described in order to illustrate the invention, the invention includes various modifications and equivalents to the disclosed embodiment, only some of which have been mentioned above. It is intended that the invention include all such modifications and equivalents falling within the scope of the appended claims.

What is claimed:

1. A socket for use with a semiconductor device having a plurality of terminals arranged in a pattern comprising a base, an adapter mounted on the base having a semiconductor device mounting seat, a plurality of contact members each having first and second end portions, one end portion of each contact member being fixed to the base in a pattern corresponding to the pattern of the semiconductor device terminals, the other end portion of each contact member having a pair of generally parallel extending arms, each arm having a free distal tip portion, the arms of each pair being movable toward and away from each other to nip and release a respective semiconductor device terminal of a semiconductor device placed on the mounting seat, each arm formed with a butting surface aligned with, extending toward and engageable with the butting surface of the other arm of a respective pair to determine the minimum spacing distance between the tip portions of the arms when the butting surfaces of a pair engage each other, a plurality of contact member opening and closing members, a respective contact opening and closing member disposed between the arms of each contact member and being movable between a first position biasing at least one arm of the respective pair to open the tip portions of the arms and a second position where engagement of the butting surfaces with each other is permitted, and an opening and closing mechanism that moves the contact member opening and closing members between the first and second positions.

2. A socket according to claim 1 in which the contact member opening and closing members are moved vertically away from and toward the base by the opening and closing mechanism.

3. A socket according to claim 1 in which an opening and closing members engage the butting surface of each arm at the first position to bias the tips of each pair of arms apart.

4. A socket according to claim 1 in which the tip portion of each arm extends in a direction toward the tip portion of the other arm of a respective pair of arms.

5. A socket according to claim 1 in which the opening and closing members and the arms of the contact members are formed so that there is a selected clearance therebetween when the opening and closing members are at the second position.

6. A socket according to claim 4 in which the semiconductor device has a bottom surface and the terminals extend from the bottom surface and are generally spherical having a maximum diameter portion lying in a first plane parallel to the bottom surface and a smaller diameter in planes parallel to the first plane between the first plane and the bottom surface wherein the pair of arms of each contact member engage a respective terminal closer to the bottom surface than the first plane.

7. A socket according to claim 1 further comprising a slider formed with a guide through hole for each contact member with the arms of a contact member received through a respective through hole, the slider being movably mounted and moved by the opening and closing mechanism and a contact member opening and closing member being formed in each respective through hole in the slider.

8. A socket according to claim 7 in which the slider comprises semiconductor device support portions which protrude above the mounting seat of the adapter when the contact member opening and closing members are located at the first position whereby a semiconductor device can be placed on the support portions, the support portions receding below the mounting seat as the contact member opening and closing members move to the second position with each semiconductor device terminal moving between the arms of a respective contact member.

9. A socket according to claim 1 in which the opening and closing mechanism comprises a latch movably mounted on the base and having an opened position where a semiconductor device can be placed at the mounting seat of the adapter and a closed position where a semiconductor device that has been placed at the mounting seat can be held.

10. A socket according to claim 9 in which the opening and closing mechanism includes a cover movably mounted on the base between a first position proximate to the base and a second position removed from the base, the opening and closing mechanism cover operatively connected to the latch to move the latch to the opened position when the contact member opening and closing members are moved to the first position and causing the latch to move to the closed position when the contact opening and closing members are moved to the second position.

11. A socket according to claim 10 in which the opening and closing mechanism includes an operating lever rotatably mounted on the base which is engaged and rotated by the cover when the cover is moved between the second and first positions, the lever having a portion which engages the slider and which moves the slider by movement of the lever.

12. A socket according to claim 1 in which the semiconductor terminals have a first pitch further comprising a plurality of socket terminals for mounting the socket on a printed substrate arranged in conformity with the pitch of respective conductive pads on the printed substrate having a second, different pitch and a connector for electrically connecting each of the contact members with a respective socket terminal.

13. A socket according to claim 12 in which the connector comprises an expansion board attached to the base, the expansion board mounting the socket terminals, the fixed end of the contact members extending through apertures in the expansion board and circuit traces are disposed on the expansion board which extend between each socket terminal and a respective contact member.

14. A socket according to claim 12 in which the connector comprises an expansion board attached to the base, the expansion board mounting the socket terminals, a respective conductive wire having an end electrically connected to the fixed end of each contact member and another end electrically connected to a respective socket terminal.

15. A socket according to claim 12 in which the connector comprises an expansion board attached to the base, the expansion board mounting the socket terminals, a flexible circuit having conductive traces and apertures mounted on the expansion board, the socket terminals and the fixed end of the contact members received through respective apertures in the flexible circuit and being soldered to conductive traces, a conductive trace extending between the fixed end of each contact member and a respective socket terminal.

16. A socket according to claim 12 in which the connector comprises an expansion board attached to the base, the expansion board mounting the socket terminals, the expansion board having conductive pads on a surface thereof, the fixed end of each contact member being aligned with and biased into engagement with a respective conductive pad, and a conductive trace extending between each conductive pad and a respective socket terminal.

17. A socket according to claim 12 in which the connector comprises an expansion board attached to the base, the expansion board mounting the socket terminals, the expansion board having a plurality of bores, a contact member female socket received in each bore and the fixed end of each contact member received in a respective contact member female socket, the contact member sockets being electrically connected to respective socket terminals.

18. A socket according to claim 12 in which the connector comprises an expansion board and a separate support member attached to the base and being aligned with each other, the expansion board formed with a plurality of female sockets and having contact member contact portions, the support member mounting the socket terminals with the socket terminals each having a portion extending through the support member and into a respective female socket, the fixed end of each contact member electrically connected to a respective contact member contact portion and electrical traces extending between each female socket and a respective contact member contact portion.

19. A socket according to claim 12 in which the connector comprises a first lead guide mounted on the base having lead guide openings aligned with the fixed end of respective contact members and a second lead guide mounted on the base aligned with and spaced from the first lead guide, the second lead guide having guide openings spaced further apart from one another than the lead guide openings in the first lead guide and conforming to a selected pattern on a circuit substrate to which the socket is to be mounted.

* * * * *